US010036176B1

(12) United States Patent
Taylor et al.

(10) Patent No.: US 10,036,176 B1
(45) Date of Patent: Jul. 31, 2018

(54) MOTION DAMPING SYSTEM DESIGNED FOR REDUCING OBSTRUCTION WITHIN OPEN SPACES

(71) Applicant: TAYLOR DEVICES, INC., North Tonawanda, NY (US)

(72) Inventors: Douglas P. Taylor, North Tonawanda, NY (US); Michael C. Constantinou, Buffalo, NY (US); John C. Metzger, Lockport, NY (US)

(73) Assignee: TAYLOR DEVICES, INC., North Tonawanda, NY (US)

( * ) Notice: Subject to any disclaimer, the term of this patent is extended or adjusted under 35 U.S.C. 154(b) by 0 days.

(21) Appl. No.: 15/440,747

(22) Filed: Feb. 23, 2017

Related U.S. Application Data

(63) Continuation of application No. 13/924,234, filed on Jun. 21, 2013, now Pat. No. 9,580,924.

(51) Int. Cl.
*E04H 9/02* (2006.01)
*E04B 1/98* (2006.01)

(52) U.S. Cl.
CPC ..... *E04H 9/027* (2013.01); *E04B 1/98* (2013.01); *E04H 9/028* (2013.01)

(58) Field of Classification Search
CPC .. E04H 9/02; E04H 9/021; E04H 9/00; E04H 9/024; E04H 12/10; E04B 1/98; E04B 1/985; E04B 2001/2496; E04B 2001/3583; F16F 15/02; F16F 7/00; E04C 2003/026; E04C 3/02
See application file for complete search history.

(56) References Cited

U.S. PATENT DOCUMENTS 4,350,233 A * 9/1982 Buckley ..... E04B 1/985 188/268
5,259,159 A * 11/1993 Kawase ..... E02D 27/34 52/1
5,386,671 A * 2/1995 Hu ..... E04H 9/02 52/167.3
5,870,863 A * 2/1999 Taylor ..... E04H 9/02 248/632
5,934,028 A * 8/1999 Taylor ..... E04H 9/02 248/632
6,192,637 B1 * 2/2001 Boilen ..... B60J 5/12 160/133
6,397,528 B1 * 6/2002 Rahimian ..... E04H 9/02 52/167.1
6,840,016 B1 * 1/2005 Mualla ..... E04H 9/02 52/167.1
2001/0045069 A1 * 11/2001 Constantinou ..... E04H 9/02 52/167.3
2008/0250746 A1 * 10/2008 Nawrotski ..... E04H 9/02 52/653.1

* cited by examiner

*Primary Examiner* — Gisele D Ford

(74) *Attorney, Agent, or Firm* — Lukacher Law Group; R. S. Rosenholm

(57) ABSTRACT

The invention provides for a method, system and apparatus for resisting and restraining potentially destructive movement within a building structure while introducing little or no obstruction with respect to how a building structure is designed and how it is intended to function.

20 Claims, 17 Drawing Sheets

MOTION DAMPING SYSTEM DESIGNED FOR REDUCING OBSTRUCTION WITHIN OPEN SPACES

CROSS REFERENCE TO RELATED PATENT APPLICATION(S)

This document is a continuing U.S. non-provisional utility patent application being filed under 37 CFR 1.53(b), that claims priority and benefit to, U.S. non-provisional utility patent application Ser. No. (13/924,234) which was filed on Jun. 21, 2013, and that is entitled "MOTION DAMPING SYSTEM DESIGNED FOR REDUCING OBSTRUCTION WITHIN OPEN SPACES", and which is also incorporated herein by reference in its entirety.

This document claims priority and benefit to any and all of the above aforementioned patent application(s), which are each incorporated by reference herein into this document in each of their entirety.

CROSS REFERENCE TO RELATED SUBJECT MATTER

This document is a United States non-provisional utility patent application. This document includes subject matter that appears related to subject matter described within U.S. Patent(s) U.S. Pat. Nos. 5,934,028 and 5,870,863 to Taylor, which are each entitled "Toggle Linkage Seismic Isolation Structure", and to subject matter described within U.S. Pat. No. 6,438,905 to Constantinou, entitled "Highly Effective Seismic Energy Dissipation Apparatus" and to U.S. Patent to Haskell, which is entitled "Building Damper Apparatus". The above aforementioned patent documents are herein incorporated by reference in their entirely.

BACKGROUND OF THE INVENTION

Building structures are at risk from damage and destruction from various harmful events, including for example, earthquakes, wind storms and explosions. These harmful events can cause unwanted motion within the building structure leading to damage and/or destruction of the building. The resistance of a building to such harmful events can be reinforced via addition to the building structure of apparatus that is designed to reduce the unwanted and damaging motion within the building structure itself. However, measures to reinforce a building structure can cause interference with respect to how a building structure is designed and how it is intended to function.

The discussion above is merely provided for general background information and is not intended to be used as an aid in determining the scope of the claimed subject matter.

BRIEF DESCRIPTION OF THE INVENTION

The invention provides for a method, system and apparatus for resisting and restraining potentially destructive movement within a building structure while introducing little or no obstruction with respect to how a building structure is designed and intended to function.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention can encompass other equally effective embodiments.

The drawings are not necessarily to scale. The emphasis of the drawings is generally being placed upon illustrating the features of certain embodiments of the invention. In the drawings, like numerals are used to indicate like parts throughout the various views. Differences between like parts may cause those parts to be indicated with different numerals. Unlike parts are indicated with different numerals. Thus, for further understanding of the invention, reference can be made to the following detailed description, read in connection with the drawings in which.

DETAILED DESCRIPTION OF THE INVENTION

Figure 1A:
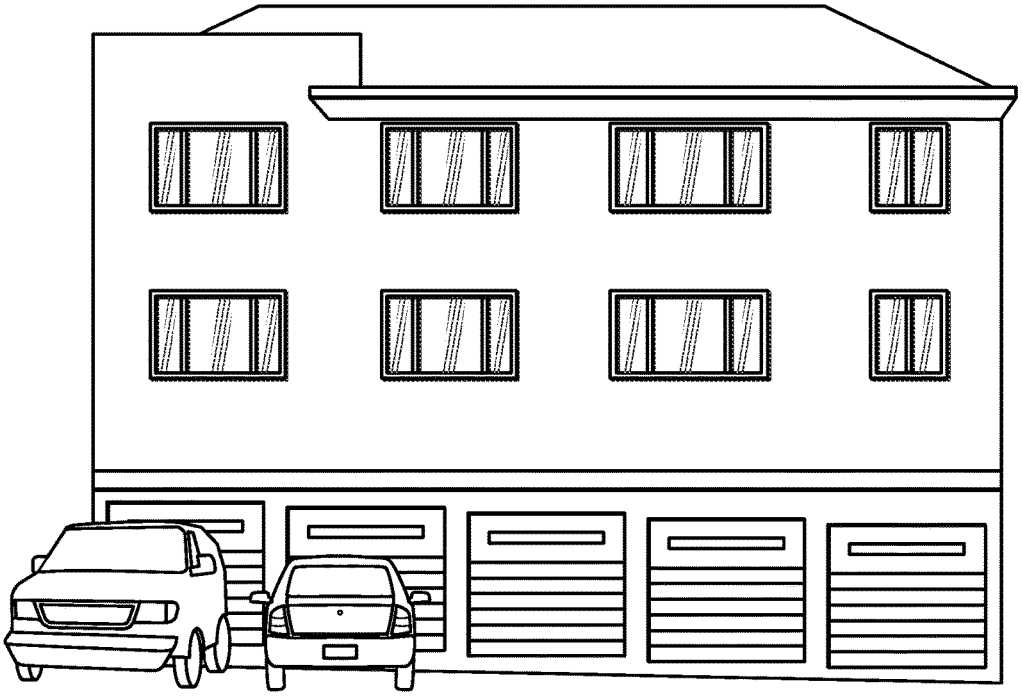
FIG. 1A (PRIOR ART)
FIG. 1A illustrates a building structure including ground level bays (open spaces) that are designed to provide storage (ingress and egress) for road vehicles.

FIG. 1A illustrates a building structure including ground level bays (open spaces) that are designed to provide storage (ingress and egress) for road vehicles. As shown, there are (5) garage doors that each provide access to a ground level bay for which a road vehicle can be sheltered.

Figure 1B:
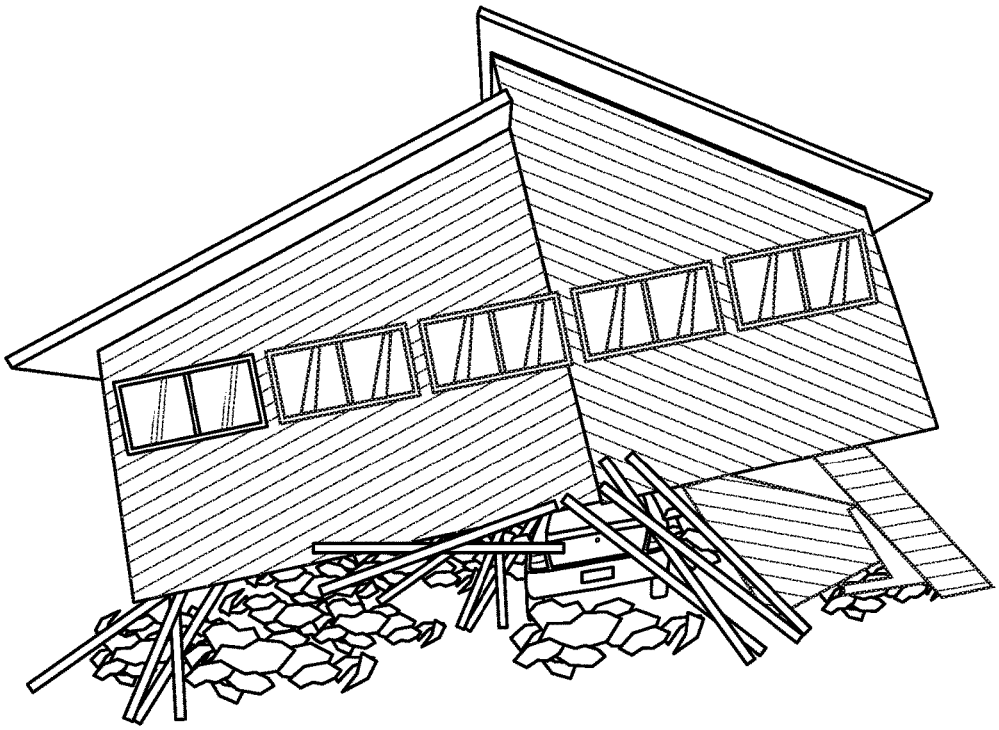
FIG. 1B (PRIOR ART)
FIG. 1B illustrates a building structure, similar to that of FIG. 2A, that has suffered catastrophic damage from a seismic event.
Figure 2A:
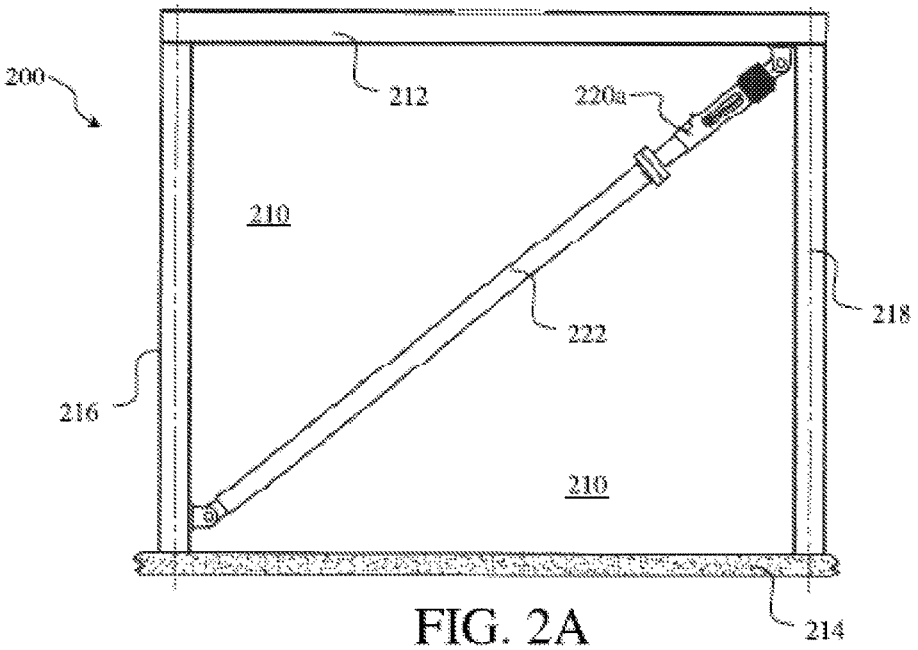
FIGS. 2A-2G each illustrates various embodiments of prior art apparatus employed to absorb and remove seismic energy within a building structure during a seismic event.

FIG. 1B illustrates a building structure, similar to that of FIG. 2A, that has suffered catastrophic damage from a harmful event. As shown, a lower portion of a building structure has collapsed as a result of this harmful event. The lower portion of the building structure appears to have included ground level bays including at least one garage (ground level bay) for shelter of an automobile. An upper portion of the building structure appears to have collapsed onto an automobile that was located within one of the ground level bays.

FIGS. 2A-2G each illustrate various embodiments of prior art apparatus employed to absorb and remove seismic energy within a building structure during a seismic event.

FIG. 2A is a diagram that illustrates an apparatus designed to resist movement of structural members that are located along a perimeter of a bay 210 within a building structure. This apparatus includes a damper 220*a* and a rod 222 that are attached in series and that together span between a lower left hand corner and an upper right hand corner of a bay 210 within a building structure.

Figure 2B:
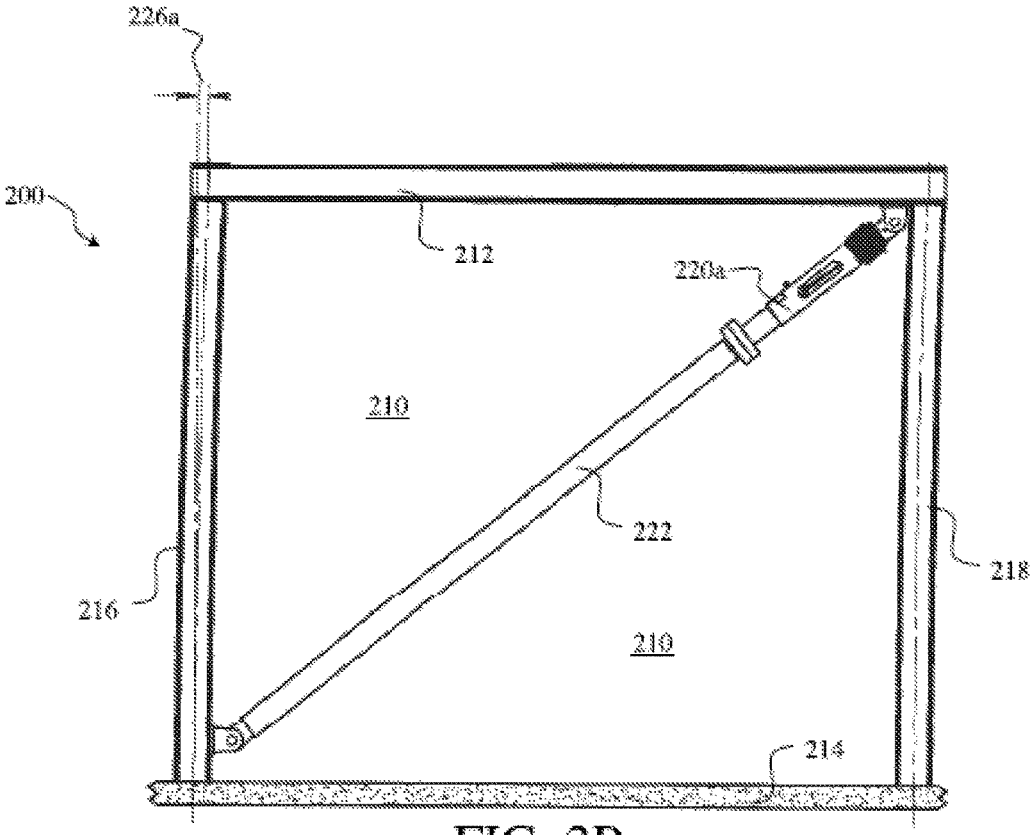

FIG. 2B illustrates the apparatus 200 of FIG. 2A under relative motion. A deflection angle 226*a* indicates a rightward motion of an upper beam 212 relative to a lower beam 214 of the bay 210.

The design of this apparatus visually and physically obstructs an otherwise accessible area located within the bay 210. For example, if this bay functioned as an opening to a garage, installation of the apparatus 200 would obstruct and prevent an automobile from passing through the bay 210 to enter or exit the garage. If this bay were a window, the apparatus would at least partially obstruct a view through this window.

Figure 2C:
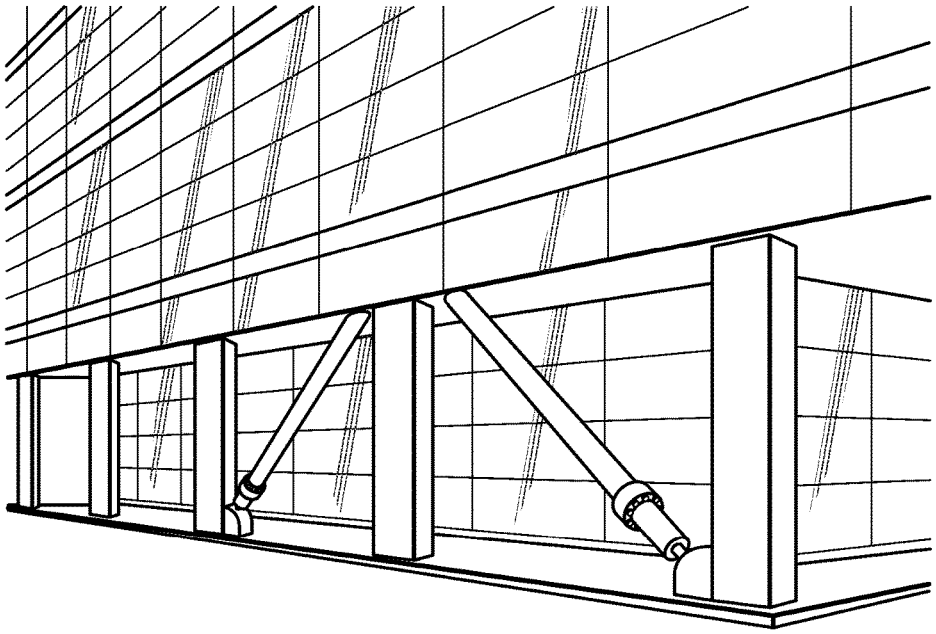
FIG. 2C (PRIOR ART)

FIG. 2C is a photograph of an apparatus like that of FIG. 2A, as it is installed within outdoor ground level bays of a building structure. As shown, the ground level bays are designed to pass visual light and air and are not designed for passage of a large physical object, such as that of an automobile.

Figure 2D:
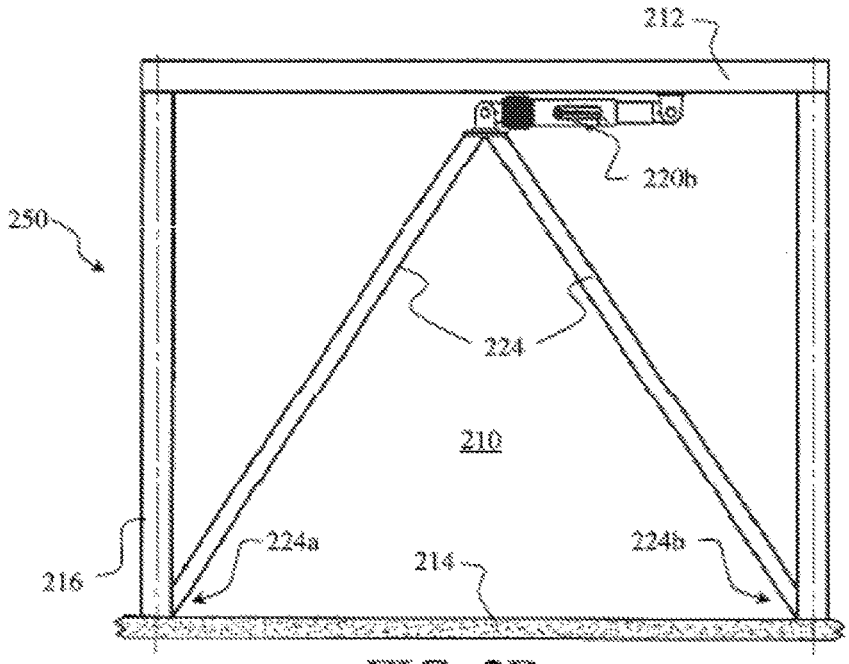

FIG. 2D is a diagram that illustrates an apparatus 250 designed to resist movement of structural members that are located along a perimeter of a bay 210 within a building structure. This apparatus includes a damper 220*b* that is pivot attached to an upper beam 212 and pivot attached to a top portion of a peak shaped structure 224. This peak shaped structure is also referred to as a chevron brace. A bottom portion of the peak shaped structure 224 has a first end 224*a* and a second end 224*b* that are each is fixedly attached to a lower left corner and to a lower right corner respectively, of the bay 210.

Figure 2E:
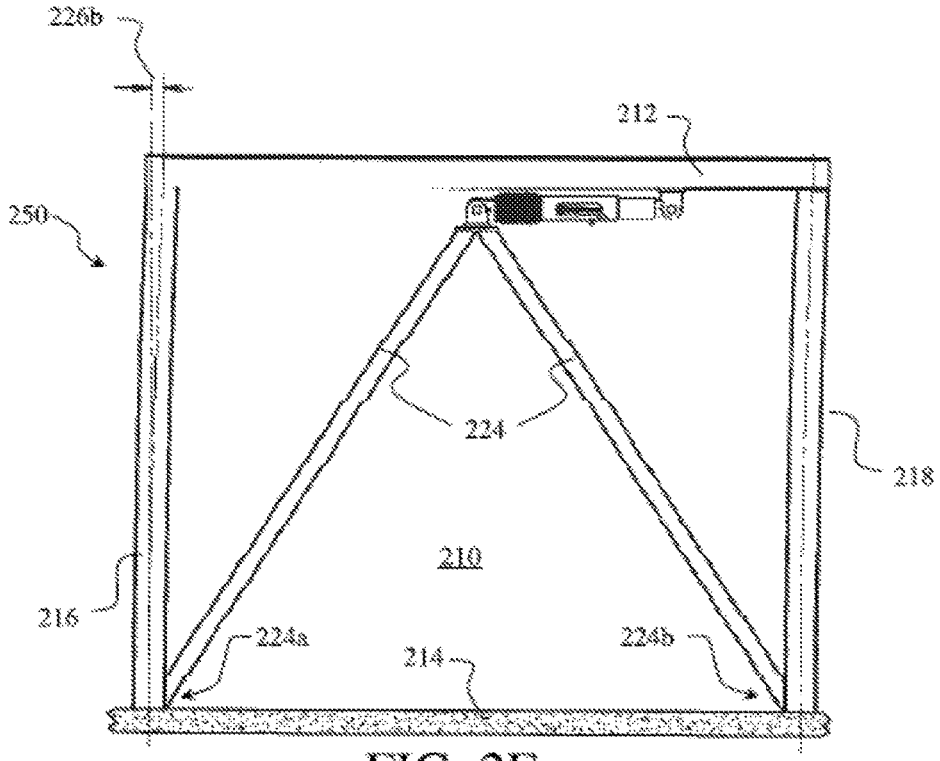

FIG. 2E illustrates the apparatus 250 of FIG. 2D under relative motion. A deflection angle 226*b* indicates a rightward motion of an upper beam 212 relative to a lower beam 214 of the bay 210.

Figure 2F:
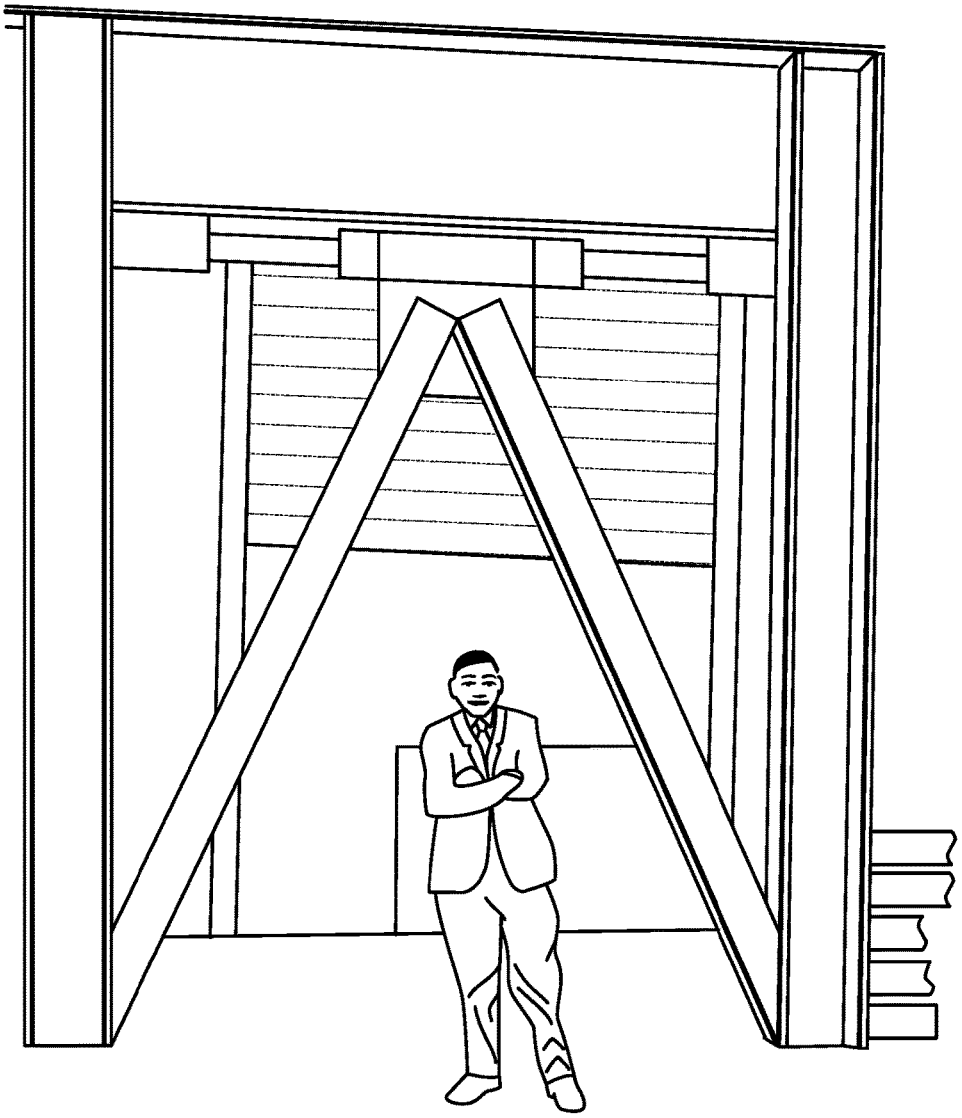
FIG. 2F (PRIOR ART)

FIG. 2F is a photograph of an apparatus like that of FIG. 2D, as it is installed within an indoor bay of a building structure. As shown, the bay is not designed for passage of an automobile.

Figure 2G:
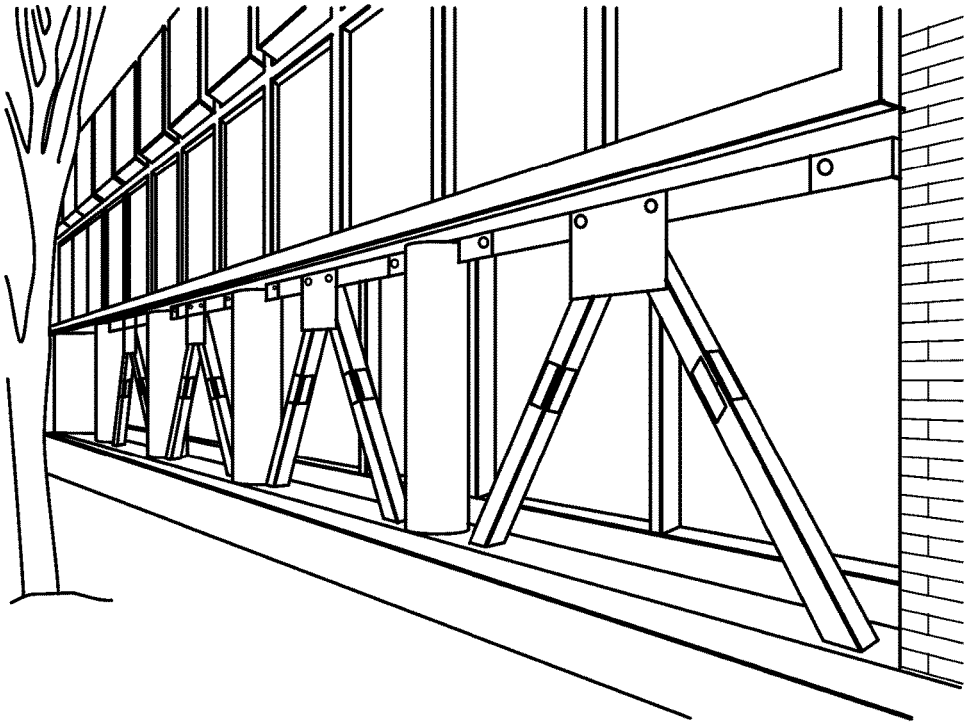
FIG. 2G (PRIOR ART)

FIG. 2G is a photograph of an apparatus like that of FIG. 2D, as it is installed within outdoor and near ground level bays of a building structure. As shown, the near ground level bays are designed to pass visual light and air and are not designed for passage of large physical objects, such as automobiles.

FIGS. 3A-3D collectively illustrate two embodiments 300, 350 of a damping apparatus of the invention that each include a damper 320 that is tethered via cables 334*a*-334*b* to end anchors 330*a*-330*b*, or 330*c*-330*d*, that are mounted to structural members that are located along a perimeter portion of a bay 310. The bay 310 is located within a building structure. These damping apparatus embodiments 300, 350 are designed to resist against undesirable movement of these structural members. This damping apparatus 300, 350 is further designed to minimize visual and physical obstruction of the bay 310 that is caused by installation of the damping apparatus itself, while it is disposed within the bay 310. Any obstruction caused by this damping apparatus is substantially less than obstruction caused by many other prior art damping apparatus, such as that shown in FIGS. 2A-2G.

Figure 3A:
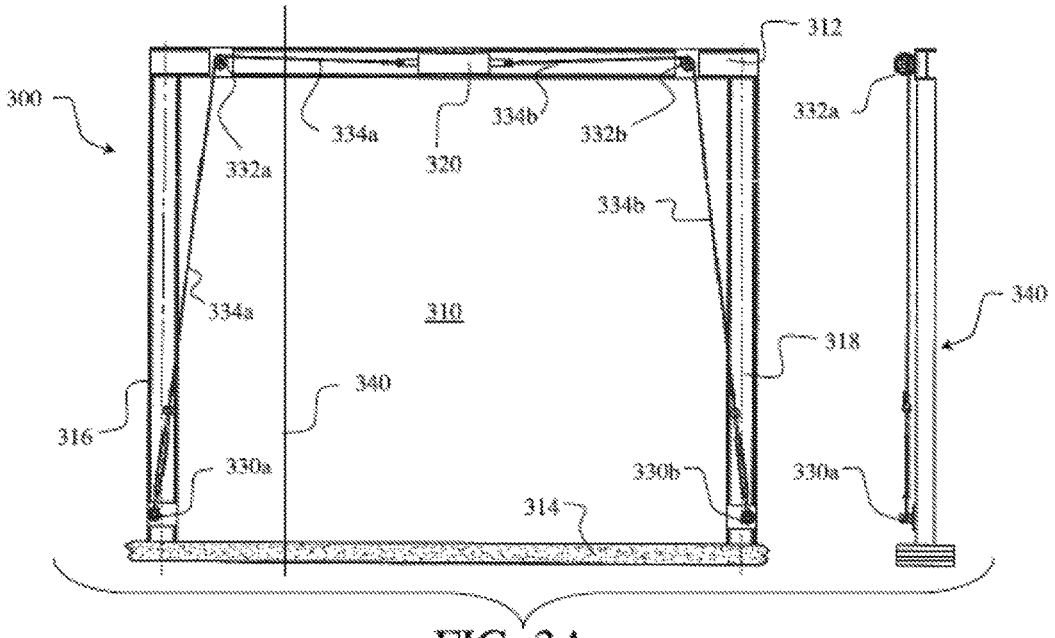
FIGS. 3A-3D illustrate two embodiments of a damping apparatus of the invention including a damper that is cable tethered to anchors located along a perimeter portion of a bay, in order to minimize obstruction within the bay.

As shown in FIG. 3A, a damper 320 is mounted (fixedly attached) to a structural member, specifically an upper beam 312, that is located along a first side of the perimeter of the bay 310. The damper 320 is designed to provide extension (tensile) resistance to pulling forces of cables 334*a*-334*b*, that are each attached to opposite sides of the damper 320. Cable 334*a* is attached to a first attachment interface (of the damper 320) that is located on a left hand side of the damper 320. The cable 334*b* is attached to a second attachment interface (of the damper 320) that is located on a right hand side of the damper 320.

Intermediate anchors 332*a* and 332*b* are each protrusions that are fixedly attached to and protrude away from a near side of the upper beam 312. The cables 334*a* and 334*b* are each arranged to make physical contact with and pass outside of and along a curved surface of each respective intermediate anchor 332*a*-332*b*, and to each fixedly attach to the damper 320. Each of the curved surfaces facilitates movement (sliding) of each respective cable 334*a*-334*b* while it is pressing against and passing outside of each respective intermediate anchor 332*a*-332*b*. An intermediate anchor including a curved surface to make physical contact with an anchor is preferred to reduce friction between the cable and the intermediate anchor, especially while there is movement of the cable while it is pressing against and being restrained by the intermediate anchor.

An intermediate anchor can be of a loop type of design, including an inner curved surface, like that of an inner surface of a donut shaped loop, for example, where the loop portion of this intermediate anchor surrounds the cable (analogous to a cable passing through a hole of a metal donut) to create a barrier to prevent lateral movement of the cable to a location that is outside of the boundary defined by the hole of the loop, but instead allowing movement of the cable so that it can be pulled in either of two opposite directions through the hole of the loop. This hole defined by the loop functions as a receiving portion within this type of intermediate anchor. Alternatively, an intermediate anchor can be of a non-loop (partial loop) design and have an outer exposed surface, such as that of the inner surface of a semi-circle, that projects towards and presses against a cable and restrains the cable from lateral movement away from the confines of the partial loop formed by the inner surface of the semi-circle. This intermediate anchor functions without entirely surrounding and restraining the cable from movement in any lateral direction, but instead allowing movement of the cable so that it can be pulled in either of two opposite directions across the inner surface of the partial loop. The inner surface of this non-loop intermediate anchor design functions as a receiving portion of this type of intermediate anchor.

The cable 334*a* has a first end that is attached to the first attachment interface on the left hand side of the damper 320 and a second end that is attached to an end anchor 330*a*. The cable 334*b* has a first end that is attached to the second attachment interface located on the right hand side of the damper 320 and a second end that is attached to the second end anchor 330*b*. The end anchor 330*a* is fixedly attached to a near side of the left column 316, which is a structural member located along a left side of the perimeter of the bay 310. The end anchor 330*b* is fixedly attached to a near side of the right column 318, which is a structural member located along a right side of the perimeter of the bay 310. As shown, the bay 310 forms a rectangular shape having (4) right angle corners separating each horizontal beam 312-314 and vertical column 316-318.

Cross-section viewing perspective 340 illustrates a cross-sectional side view of the apparatus 300 as installed onto the bay 310. The intermediate anchor 332*a* is shown protruding away from upper beam 312. The end anchor 330*a* is shown protruding away from the left column 316.

Figure 3B:
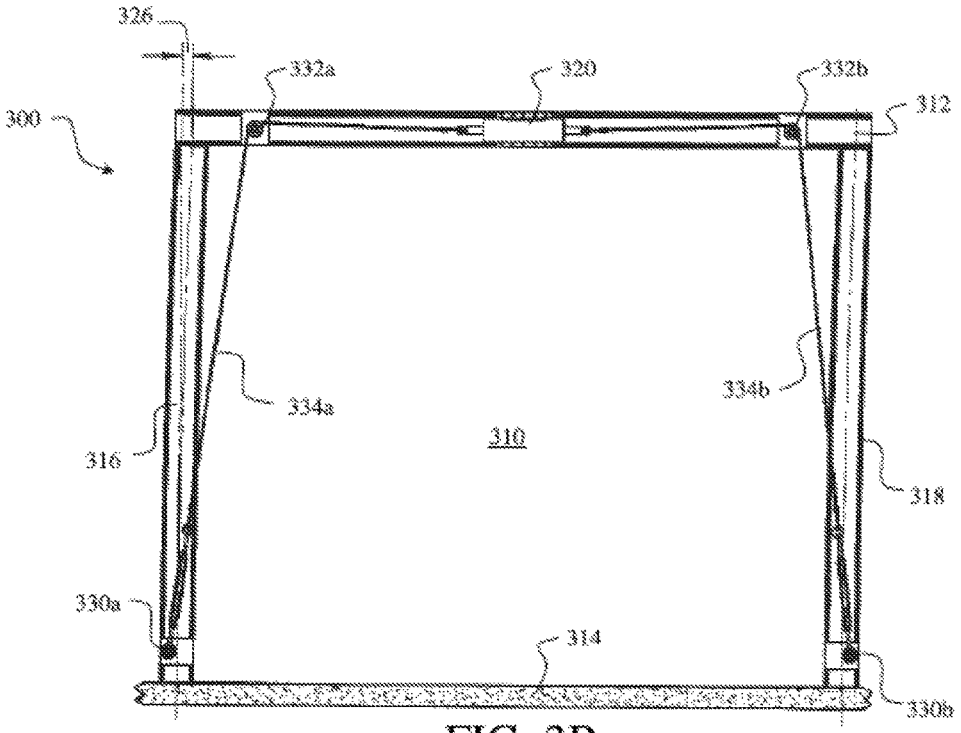

As shown in FIG. 3B, when under stress, from perhaps a potentially harmful event, relative motion can occur between the earth and the building structure, between the earth and at least a portion of the bay 310, and within the bay 310 itself. This relative motion can cause deflection among the beams 312-314 and columns 316-318 of the bay 310.

With the deflection, as shown within FIG. 3B, the upper beam 312 moves slightly towards a right hand direction relative to the lower beam 314, as measured by a deflection angle 326. During this deflection, vertical columns 316-318 slightly tilt in a clockwise direction and an upper portion of each column 316-318 moves towards the right hand direction while attached to the upper beam 312, and a lower portion of each column 316-318 remains attached to the lower beam 314.

Figure 3C:
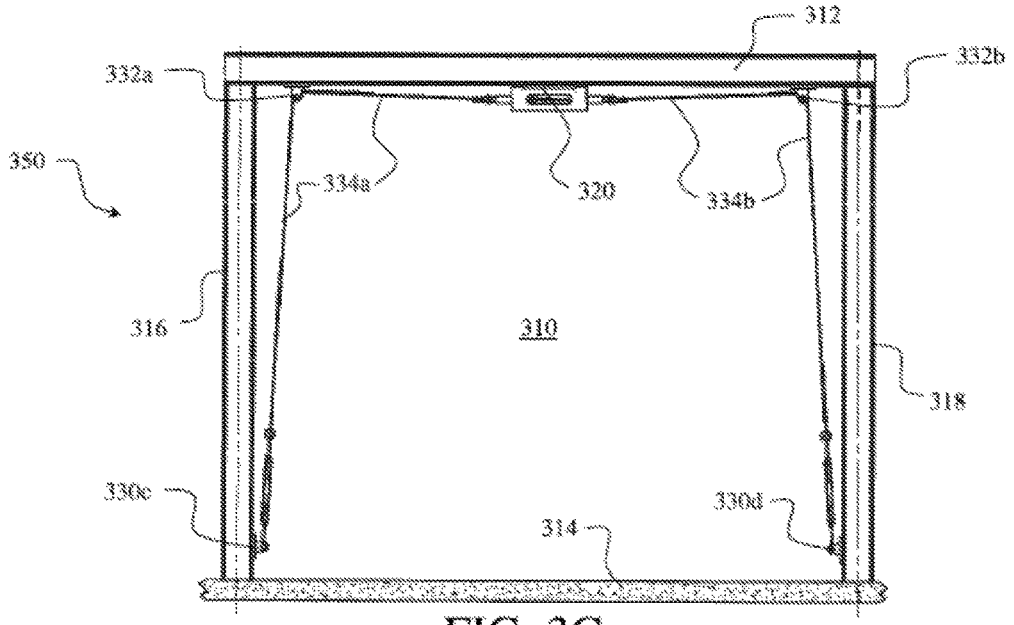

FIG. 3C shows a damping apparatus like that of FIG. 3A, except for that intermediate anchors 332*c* and 332*d* are each located on a lower side of the upper beam 312. Also, the end anchors 330*c* and 330*d* are located on an inner side of the vertical columns 316-318 respectively.

Figure 3D:
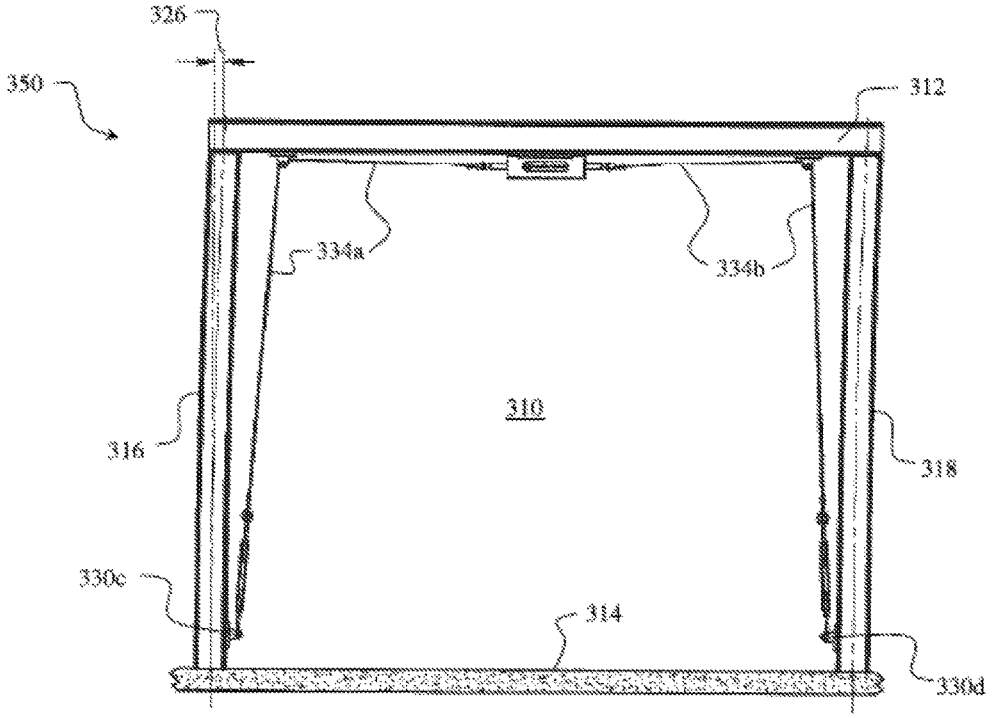

As shown in FIG. 3D, when under stress, relative motion can occur between the earth and the building structure, between the earth and the bay 310, and within the bay 310 itself. This relative motion can cause deflection and/or deformation among the beams 312-314 and columns 316-318 that are located along a perimeter of the bay 310.

With relative motion, as shown within FIG. 3D, the upper beam 312 moves slightly towards a right hand direction relative to the lower beam 314, as measured by a deflection angle 326. During this deflection, vertical columns 316-318 slightly tilt in a clockwise direction where an upper portion of each column 316-318 moves towards the right hand direction while attached to the upper beam 312, and a lower portion of each column 316-318 remains attached to the lower beam 314.

It should be understood that only a small amount of deflection of the bay, as a result of relative motion, can cause catastrophic damage to the bay 310 and to the building structure itself. For example, in typical building structures, as little as a (5) degree deflection angle to a bay, can cause permanent damage and/or to or even collapse of the building structure itself.

In some embodiments, for example, the damper has an extension stroke rating of 2 inches and a maximum extension and/or compression resistance force rating of 10,000 pounds. In other embodiments, the stroke of the damper is 10 inches and its maximum extension and/or compression resistance is 500,000 pounds. Note however that a 500,000 pound rated damper would have a much larger width dimension (perpendicular to a direction of the stroke) than that of the 10,000 pound rated damper.

In some embodiments, the intermediate and end anchors are typically made from a metallic material, for example a steel alloy, and are fastened to respective structural members via a metal band that is designed to wrap around each respective structural member.

In some embodiments, cables 334*a*-334*b* are made from one quarter inch diameter metallic material, such as a steel alloy, and can withstand a maximum tensile force of approximately 2.5 tons. In other embodiments, the cables 334*a*-334*b* are made from one half inch diameter metallic material, such as a steel allow, and can withstand a maximum tensile force of approximately 20 tons. Some cables having a diameter of 2 inches can withstand a maximum tensile force of 200 tons.

The above described invention is not limited to the arrangement (3) shown in FIGS. 3A-3D. Although the lower beam 314 is shown as having no attached end anchors, in other embodiments, one or both end anchors 430*a*-430*b* may be attached to the lower beam 314. In other embodiments, one or both of the intermediate anchors 332*a*-332*b* can be mounted onto the left column 316 and right columns respectively.

In other embodiments, the damper 320 can mounted on a structural member other than the upper beam 312. For example, the damper 320 and intermediate anchors 332*a*-332*b* can be located on the lower beam 314 while the end anchors 330*a*-330*b*, 330*c*-330*d* are each located on an upper portion of the left and right columns respectively. Also, in some embodiments, the damper 320 is instead mounted on a column 316, 318 while the intermediate anchors 332*a*-332*b*, and optionally the end anchors 330*a*-330*b* or 330*c*-330*d* are mounted onto a respective beams 312, 314.

In another one half sided (mirrored) embodiment, the damper 320 has one attachment interface, one cable 334*a*, one intermediate anchor 332*a* and one end anchor 330*a*, and consequently, resists motion traveling in only one first direction. As shown, this one half sided embodiment would resist relative motion along a first direction from a left hand to a right hand side of the bay 310.

However, another mirror image of this one half side embodiment, including another damper 320, one other cable 334*b*, one other intermediate anchor 332*b* and on other end anchor 330*b*, is designed to resist motion in a second direction of relative motion that is opposite to the first direction, and is installed into another bay (not shown), that is horizontally adjacent to bay 310 for example. The another bay that is located for example, adjacent to the right hand side of the bay 310 shown in FIGS. 3A-3D. In this arrangement, each side of the damping apparatus 300 is separately and respectively installed into each one of the pair of horizontally adjacent bays and each one side of the apparatus is designed to resist each relative motion from the respective two opposite directions that collectively affects this pair of horizontally adjacent bays. As an example showing the concept of this type of embodiment, see FIGS. 6A-6B as an example of each mirrored one half side of a damping system 600 that is instead installed into each horizontal half of one bay. Each side of this damping apparatus resists forces in opposite directions. Each side of this damping system can instead be installed into separate and horizontally adjacent bays within a building structure.

Figure 4A:
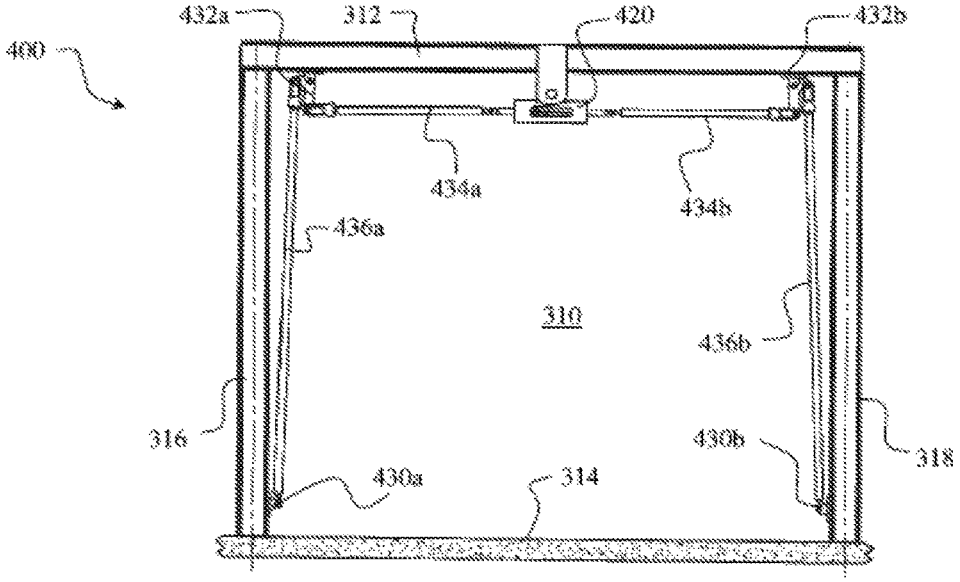
FIGS. 4A-4B illustrate an embodiment of a damping apparatus of the invention including actuator rods and rotatable lever arms and a damper located proximate to an upper portion of a bay.
Figure 4B:
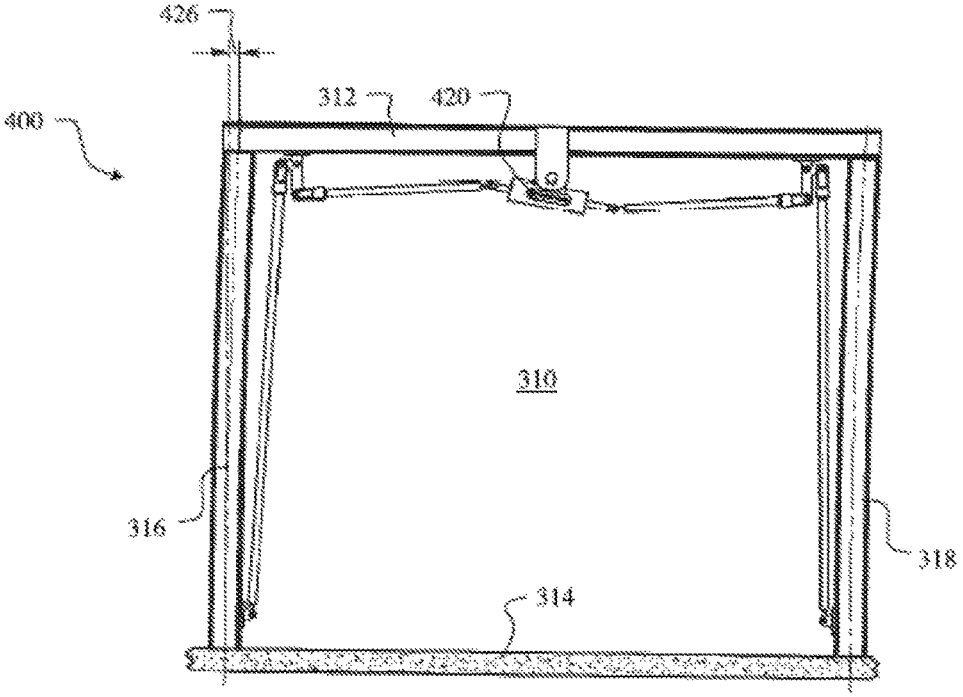

FIGS. 4A-4B illustrate an embodiment 400 of a damping apparatus of the invention that includes a damper 420 that is physically attached to a first end of rod 434*a* and to a first end of a rod 434*b*. Each rod 434*a*-434*b* also has a second end that is each attached to a separate bell crank 432*a*-432*b* respectively. Bell crank 432*a* and 432*b* are each fixedly attached to and located on an under side of the upper beam 312 of bay 310. Bell crank 432*a* is also attached to a first end of rod 436*a* and bell crank 432*b* is also attached to a first end of rod 436*b*. Rod 436*a* has a second end that is fixedly attached to end anchor 430*a*, which is fixedly attached to an inner surface of the left hand column 316. Rod 436*b* has a second end that is fixedly attached to end anchor 430*b*, which is fixedly attached to an inner surface of the right hand column 318.

This damping apparatus embodiment 400 is designed to resist and restrain movement of structural members of the bay 310 of the building structure. The damping apparatus is further designed to reduce visual and physical obstruction of the bay 310 that is caused by the damping apparatus being disposed within the bay 310, as compared to obstruction caused by another prior art damping apparatus, such as that shown in FIGS. 2A-2G.

As shown in FIG. 4A, a damper 420 is swivel mounted and fixedly attached to a structural member, and is here shown to be specifically attached to an upper beam 312, that is located along a first side of the perimeter of the bay 310. The damper 420 is designed to provide at least one of extension (tensile) resistance to pulling forces of the rods 434*a*-434*b* and compression resistance to pushing forces of the rods 434*a*-434*b* that are each attached to opposite sides of the damper 420. Preferably, the damper 420 provides both extension and compression resistance to pulling and pushing forces of the rods 434*a*-434*b* respectively. Rod 434*a* is attached to a first attachment interface (of the damper 420) that is located on a left hand side of the damper 420. The rod 434*b* is attached to a second attachment interface (of the damper 420) that is located on a right hand side of the damper 420.

Bell cranks 432*a* and 432*b* are fixedly attached to and protrude away from an underside of the upper beam 312. A pushing force from rod 436*a* causes bell crank 432*a* to rotate clockwise and to pull rod 434*a* away from damper 420. A pulling force from rod 436*a* causes bell crank 432*a* to rotate counter clockwise and push rod 434*a* towards damper 420. Likewise, a pushing force from rod 436*b* causes bell crank 432*b* to rotate counter clockwise and to pull rod 434*b* away from damper 420. A pulling force from rod 436*b* causes bell crank 432*b* to rotate clockwise and push rod 434*a* towards damper 420.

As shown in FIG. 4B, when under stress, relative motion can occur between the earth and the building structure, between the earth and at least a portion of the bay 310 and between portions of the bay 310 itself. This relative motion can cause deflection among the beams 312-314 and columns 316-318 of the bay 310.

With deflection, as shown within FIG. 4B, the upper beam 312 moves slightly towards a right hand direction relative to the lower beam 314, as measured by a deflection angle 426. During this deflection, vertical columns 316-318 slightly tilt in a clockwise direction and an upper portion of each column 316-318 moves towards the right hand direction while attached to the upper beam 312, and a lower portion of each column 316-318 remains attached to the lower beam 314.

The above described invention is not limited to the arrangement shown in FIGS. 4A-4B. The damper 420 can be located on a different structural member along the perimeter of the bay 310. Although the lower beam 314 is shown as having no attached end anchors, in other embodiments, one or both end anchors 430*a*-430*b* may be attached to the lower beam 314. In other embodiments, a bell crank 432*a* can be mounted onto the left column 316 and/or bell crank 432*b* can be amounted onto the right column 318.

Also, the dimensions of the bell cranks 432*a*-432*b* can be altered. Each bell crank has (lever) arms, the length of which affects an amount of leverage provided by a bell crank 432*a*-432*b* to a rod attached to it. The longer a lever arm, the more leverage and length of stroke proved to an attached rod. The shorter a lever arm, the less leverage and length of stroke provided to an attached rod. Each bell crank 432*a*-432*b* is sized to accommodate a length of stroke of a damper 420 that is attached to the bell crank 432*a*-432*b* via a rod 434*a*-434*b*.

Also note that a rod is required to have a wider dimension to withstand a compression force than is required for it to withstand an extension (tensile) force of the same strength as the aforementioned compression force. In other words, a rod of a particular diameter can withstand a much larger maximum extension (tensile) force without breaking apart than it can withstand a maximum compression force without bending.

As a result, an apparatus that resists destructive motion via resistance to extension (tensile stress), requires non damper hardware, such as metal rods that are thinner (less wide and of shorter diameter) than the rods of an apparatus that is designed to resist motion via resistance to compression. Furthermore, apparatus that is designed to resist destructive motion via resistance to extension (tensile stress), can in some circumstances, substitute one or more rods with a cable as shown in FIGS. 3A-3D, to resist such extension force loads.

Figure 5A:
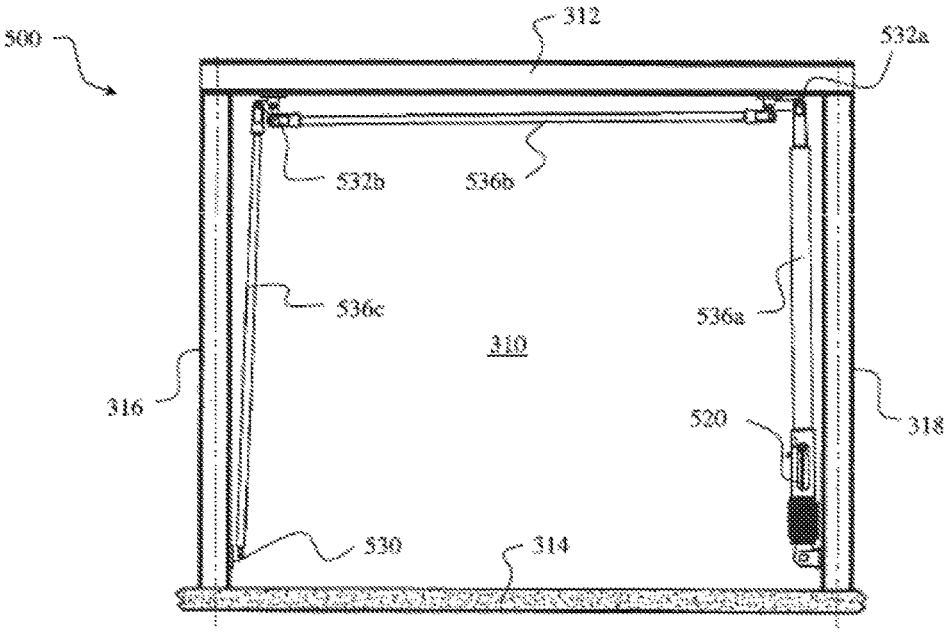
FIGS. 5A-5B illustrate an embodiment of a damping apparatus of the invention including actuator rods and rotatable lever arms attached to a damper located proximate to a side portion of a bay.
Figure 5B:
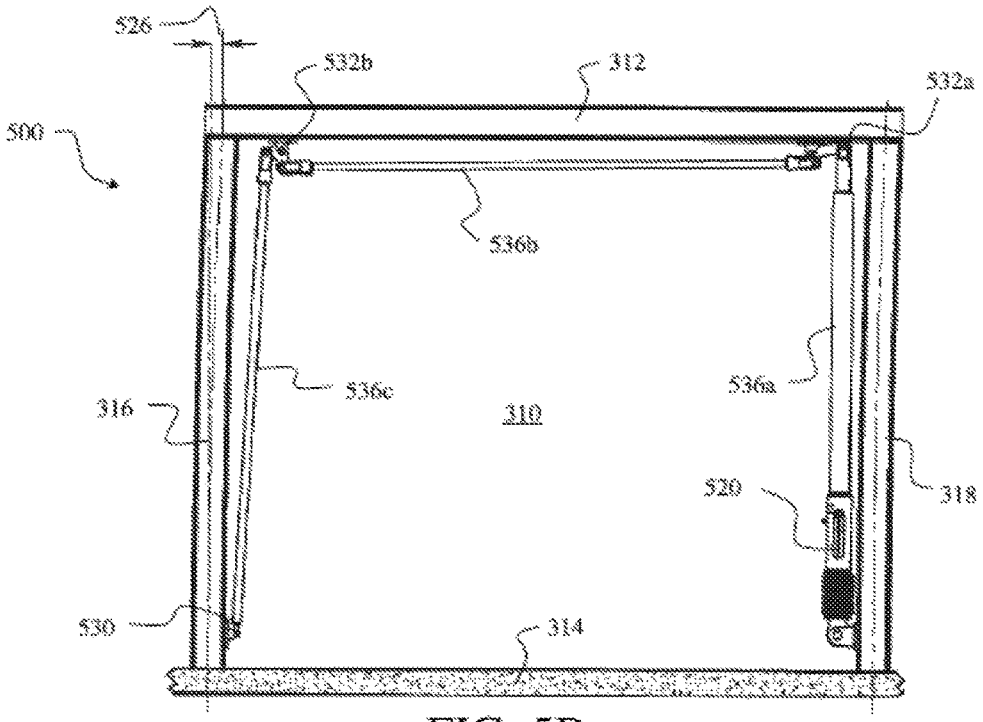

FIGS. 5A-5B illustrate an embodiment 500 of a damping apparatus of the invention that includes a damper 520 that is physically attached to a third side 318, specifically the right hand side column 318, of the perimeter of the bay 310. A first end of rod 536*a* is attached to damper 520. A second end of rod 536*a* is attached to a bell crank 532*a*. A first end of rod 536 *b* is also attached to an opposite side of bell crank 532*a*. A second end of rod 536*b* is attached to bell crank 532*b*. A first end of rod 536*c* is attached to bell crank 532*b*. A second end of rod 536*c* is attached to an end anchor 530. The end anchor 530 is fixedly attached to an inner side of the left hand column 316.

Like prior embodiments of the invention, this damping apparatus embodiment 500 is designed to restrain movement of structural members of the bay 310 of the building structure. The damping apparatus is further designed to reduce visual and physical obstruction of the bay 310 that is caused by the damping apparatus being disposed within the bay 310, as compared to obstruction caused by another prior art damping apparatus, such as that shown in FIGS. 2A-2E.

As shown in FIG. 5A, a damper 520 is fixedly attached to a structural member that is located along a perimeter of the bay 310. This structural member is specifically a right hand side column 318 as shown here, that is located along a third side of the perimeter of the bay 310. The damper 520 is designed to provide compression resistance to pushing forces and designed to provide extension resistance from pulling forces, via its attachment to the rod 536*a*, which is directly attached to the damper 520. The rod 536*a* is also attached to rod 536*b* via bell crank 532*a*, and rod 536*b* is also attached to rod 536*c* via bell crank 532*b*. Hence, the damper 520 is indirectly attached to rods 536*b*-536*c* via bell cranks 532*a*-532*b*, and rod 536*b* is indirectly attached to rod 536*c* via bell crank 532*b*.

Bell cranks 532*a* and 532*b* are fixedly attached to and protrude away from an underside of the upper beam 312, as shown here. When rod 536*c* is under tension, for example during relative movement as described above, a pulling force from rod 536*c* upon the bell crank 532*b* causes the bell crank 532*b* to rotate counter clockwise and to push rod 536*b* away from bell crank 532*b* and towards bell crank 532*a*. A pushing force from rod 536*b* upon bell crank 532*a* causes bell crank 532*a* to rotate counter clockwise and pull rod 536*a* away from damper 520 and causing an extension force to be applied to the damper 520.

Alternatively, if rod 536*c* is under compression, for example during some type of relative movement, a pushing force from rod 536*c* upon the bell crank 532*b* causes the bell crank 532*b* to rotate clockwise and to pull rod 536*b* towards bell crank 532*b* and away from bell crank 532*a*. A pulling force from rod 536*b* upon bell crank 532*a* causes bell crank 532*a* to rotate clockwise and push rod 536*a* towards damper 520 and causing a compression force to be applied to the damper 520.

As shown in FIG. 5B, when under stress, relative motion can occur between the earth and the building structure, between the earth and at least a portion of the bay 310 and between portions of the bay 310 itself. This relative motion can cause deflection among the beams 312-314 and columns 316-318 of the bay 310.

With deflection, as shown within FIG. 5B, the upper beam 312 moves slightly towards a right hand direction relative to the lower beam 314, as measured by a deflection angle 526. This deflection causes an extension force to be applied to rod 536*c*.

The above described invention is not limited to the arrangement shown in FIGS. 5A-5B. For example, the damper 520 can be mounted onto a structural member other than the right column 318. Accordingly, the other rods 536*a*-536*c* can be mounted onto other structural members to implement a working apparatus 500. Like stated in association with the apparatus 400 of FIGS. 4A-4B, the dimensions and design characteristics of the damper 520, of the bell cranks 532*a*-532*b* and rods 536*a*-536*c* can be altered to suite circumstances of a specific building structure.

Figure 6A:
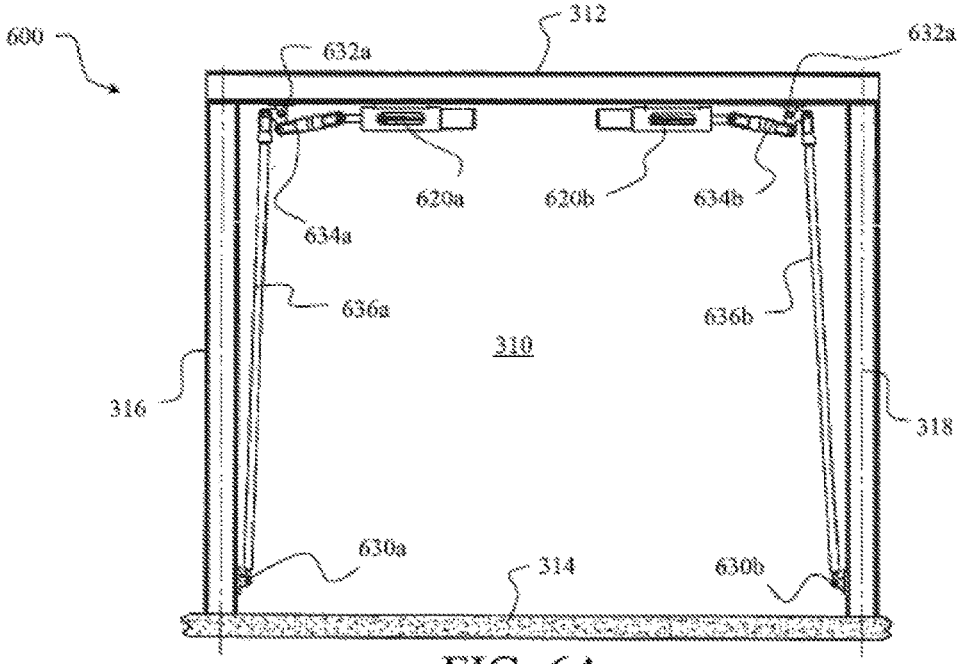
FIG. 6A-6B illustrates an embodiment of a damping apparatus of the invention including multiple dampers that are separately attached to actuator rods and a rotatable lever arm.
Figure 6B:
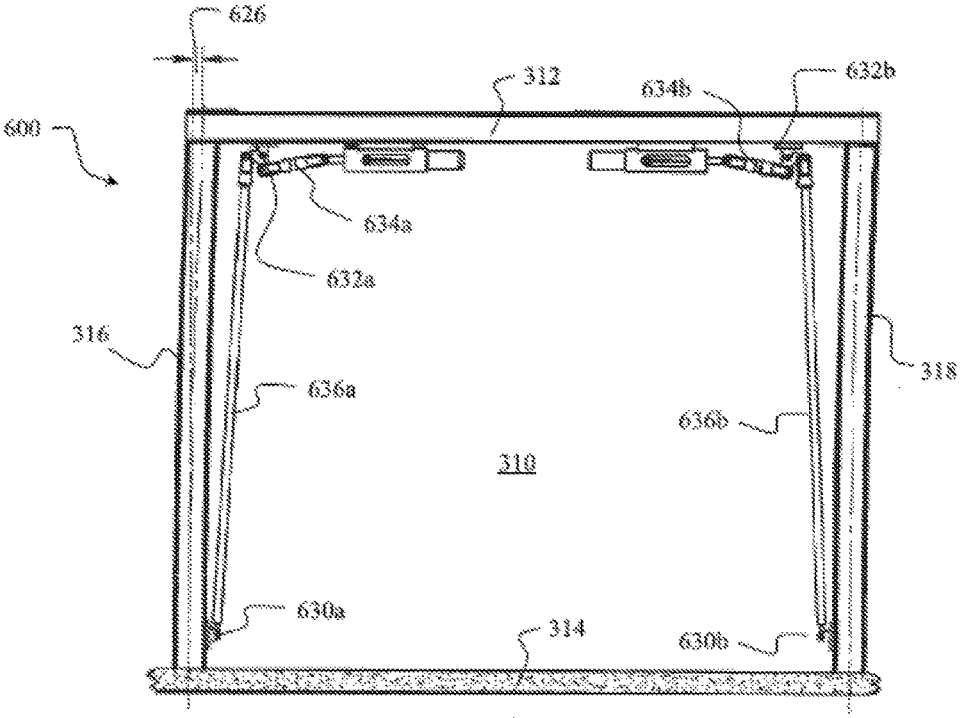

FIGS. 6A-6B each illustrate an embodiment 600 of a damping apparatus of the invention that includes a dampers 620*a*-620*b*. Damper 620*a* is physically attached to a first end of rod 634*a*. Rod 634*a* has a second end which is attached to bell crank 632*a*. Bell crank 632*a* is also attached to a first end of rod 636*a*. Rod 636*a* has a second end that is fixedly attached to end anchor 630*a* which is fixedly attached to an inner surface of the right hand column 318. Likewise, damper 620*b* is physically attached to a first end of rod 634*b*. Rod 634*b* has a second end which is attached to bell crank 632*b*. Bell crank 632*b* is also attached to a first end of rod 636*a*. Rod 636*b* has a second end that is fixedly attached to end anchor 630*b* which is fixedly attached to an inner surface of the right hand column 318.

This damping apparatus embodiment 600 is designed to restrain movement of structural members of the bay 310 of the building structure. The damping apparatus 600 is further designed to reduce visual and physical obstruction of the bay 310 that is caused by the damping apparatus 600 being disposed within the bay 310, as compared to obstruction caused by another prior art damping apparatus, such as that shown in FIGS. 2A-2G.

As shown in FIG. 6A, each damper 620*a*-620*b* is fixedly attached to a structural member, and specifically attached to an upper beam 312, that is located along a first side of the perimeter of the bay 310. Each damper 620*a*-620*b* has one attachment interface and is designed to provide at least one of a high tensile resistance to pulling forces of either of the rods 634*a*-634*b* and compression resistance to pushing forces of either of the rods 634*a*-634*b*. Rod 634*a* is attached to a first attachment interface (of the damper 620*a*) that is located on a left hand side of the damper 620*a*. The rod 634*b* is attached to a first attachment interface (of the damper 620*b*) that is located on a right hand side of the damper 620*b*.

Bell cranks 632*a* and 632*b* are fixedly attached to and protrude away from an underside of the upper beam 312. A pulling force from rod 636*a* causes bell crank 632*a* to rotate counter clockwise and push rod 634*a* towards damper 620*a* and causing a compression force to be applied to damper 620*a*. Conversely, a pushing force from rod 636*a* causes bell crank 632*a* to rotate clockwise and to pull rod 634*a* away from damper 620*a*, and a pushing force from rod 636*b* causes bell crank 632*b* to rotate counter clockwise and pull rod 634*a* away from damper 620*b*.

A pulling force from rod 636*b* causes bell crank 632*b* to rotate clockwise and to push rod 634*b* towards damper 620*b* and causing a compression force to be applied to damper 620*b*. A pushing force from rod 636*b* causes bell crank 632*b* to rotate counter clockwise and to pull rod 634*b* away from damper 620*b* and causing an extension (tensile) force to be applied to damper 620*b*.

As shown in FIG. 6B, when under stress, relative motion can occur between the earth and the building structure, between the earth and at least a portion of the bay 310 and between portions of the bay 310 itself. This relative motion can cause deflection among the beams 312-314 and columns 316-318 of the bay 310.

With deflection, as shown within FIG. 6B, the upper beam 312 moves slightly towards a right hand direction relative to the lower beam 314, as measured by a deflection angle 626. During this deflection, vertical columns 316-318 slightly tilt in a clockwise direction and an upper portion of each column 316-318 moves towards the right hand direction while attached to the upper beam 312, and a lower portion of each column 316-318 remains attached to the lower beam 314.

During this particular type of deflection, rod 636*a* applies a pulling force to bell crank 632*a* and causes bell crank 632*a* to rotate in a counter clockwise direction and to apply a pushing force to rod 634*a*, which applies a pushing force to damper 620*a*, which is resisted by damper 620. Conversely, during this particular deflection, rod 636*b* applies a pushing force to bell crank 632*b* and causes bell crank 632*b* to rotate in a counter clockwise direction and to apply a pulling force to rod 634*b*, which applies a pulling force to damper 620*b*, which is resisted by damper 620.

In one embodiment, the extension dampers 620*a*-620*b* are designed to resist a high compression force and to resist a relatively low extension force. For this embodiment, the particular relative motion of FIG. 6B would cause damper 620*a* to provide more resistance than damper 620*b*, because the damper 620*a* resistance would be provided from its relatively high compression resistance when activated as a result of this this particular type of relative motion.

However, other types of relative motion could yield a different response from this embodiment of the apparatus 600. For example, if the upper beam 312 should move in a leftward direction relative to the lower beam 314, a compressive force would be applied to the damper 620*b* and an extension force would be applied to the damper 620*a*.

In preferred embodiments, the dampers 620*a*-620*b* are each designed to provide both a relatively matched compression and extension resistance force. In other embodiments, the dampers 620 are designed to provide a larger extension resistance force than a compression resistance force, or vice versa.

The above described invention is not limited to the arrangement shown in FIGS. 6A-6B. For example, the damper 620 can be mounted onto a structural member other than the upper beam 312. Accordingly, the other rods 634*a*-634*b*, 636*a*-636*b*, can be mounted onto other structural members to implement a working apparatus 500. Like stated in association with the apparatus 400 of FIGS. 4A-4B, the dimensions and design characteristics of the damper 520, of the bell cranks 532*a*-532*b* and rods 536*a*-536*c* can be altered to suite circumstances of a specific building structure.

Although the lower beam 314 is shown as having no attached end anchors, in other embodiments, one or both end anchors 430*a*-430*b* may be attached to the lower beam 314. In other embodiments, a bell crank 432*a* can be mounted onto the left column 316 and/or bell crank 432*b* can be amounted onto the right column 318.

Notice that the apparatus 300 of FIGS. 3A-3D introduces almost no obstruction to the bay 310, except for the upper left and upper right hand corners. Such a small obstruction would permit the bay 310 of FIGS. 3A-3D, if sufficiently large, to provide passage of road vehicles. Any obstruction introduced by the apparatus 400, 500, and 600 of FIGS. 4A-4B, 5A-5B and 6A-6B is also small and confined to be located along an inside portion of the perimeter of the bay 310, and would also enable the bay 310 of FIGS. 4A-4B, FIGS. 5A-5B and FIGS. 6A-6B, if sufficiently large, to also provide passage to road vehicles.

To address visual aesthetics, coverings (not shown), typically made from plastic, rubber and/or leather, can be installed over the apparatus hardware 300, 400, 500 and 600 to create a more desired visual appearance of the installed apparatus within the context of the desired appearance and design of the building structure.

FIGS. 7A-7D collectively illustrate two embodiments 700, 750 of a damping apparatus of the invention that are each designed to resist movement across multiple bays collectively spanning multiple stories within a building structure. Each embodiment 700, 750 includes a damper 720 that is tethered via cables 734*a*-734*b* to end anchors 730*a*-730*b*, or 730*c*-730*d*, that are mounted to structural members that are located along a perimeter portion of multiple bays 710*a*-710*d*. The bays 710*a*-710*d* are located within a building structure.

Like prior described damping apparatus embodiments, these damping apparatus embodiments 700, 750 are also designed to resist against undesirable movement of the structural members that are located along the perimeter portion of these bays 710*a*-710*d*. This damping apparatus 700, 750 is further designed to minimize visual and physical obstruction of the bays 710*a*-710*d* that is caused by installation of the damping apparatus itself, while it is disposed within the bays 710*a*-710*d*. Any obstruction caused by this damping apparatus is substantially less than obstruction caused by many other prior art damping apparatus, such as that shown in FIGS. 2A-2G.

Figure 7A:
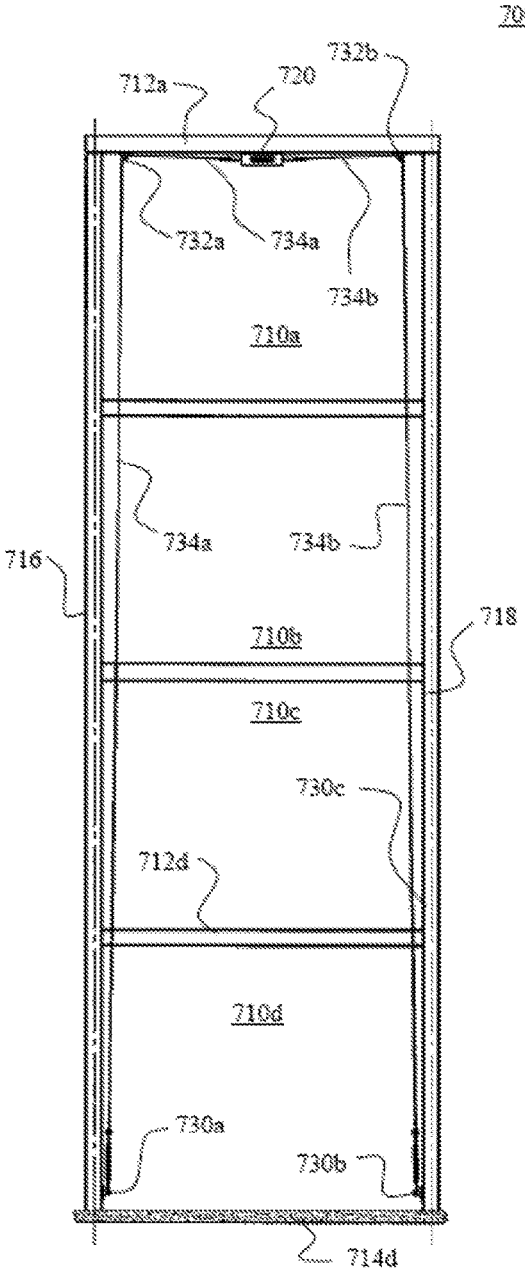
FIGS. 7A-7D collectively illustrate two embodiments of a damping apparatus of the invention that are each designed to resist relative movement with respect to a series of multiple bays each having locations collectively spanning multiple stories within a building structure.

As shown in FIG. 7A, a damper 720 is mounted (fixedly attached) to a structural member, specifically an upper beam 712*a*, that is located along a first side of the perimeter of the bay 710*a*. The damper 720 is designed to provide extension (tensile) resistance to pulling forces of cables 734*a*-734*b*, that are each attached to opposite sides of the damper 720. Cable 734*a* is attached to a first attachment interface (of the damper 720) that is located on a left hand side of the damper 720. The cable 734*b* is attached to a second attachment interface (of the damper 720) that is located on a right hand side of the damper 720.

Intermediate anchors 732*a* and 732*b* are each protrusions that are fixedly attached to and protrude away from an inner side of the upper beam 712*a*. The cables 734*a* and 734*b* are each arranged to make physical contact with and pass outside of and along a curved surface of each respective intermediate anchor 732*a*-732*b*, and to each fixedly attach to the damper 720. Each of the curved surfaces facilitates movement (sliding) of each respective cable 734*a*-734*b* while it is pressing against and passing outside of each respective intermediate anchor 732*a*-732*b*.

The cable 734*a* has a first end that is attached to the first attachment interface on the left hand side of the damper 720 and a second end that is attached to an end anchor 730*a*. The cable 734*b* has a first end that is attached to the second attachment interface located on the right hand side of the damper 720 and a second end that is attached to the second end anchor 730*b*. The end anchor 730*a* is fixedly attached to an inner side of the left column 716, which represents structural members located along a left side of the perimeter of the bays 710*a*-710*d*. The end anchor 730*b* is fixedly attached to an inner side of the right column 718, which represents structural members located along a right side of the perimeter of the 710*a*-710*d*. As shown, the bays 710*a*-710*d* form a rectangular shape having (4) right angle corners separating each horizontal beams 712*a*-714*d* and vertical columns 716-718.

Figure 7B:
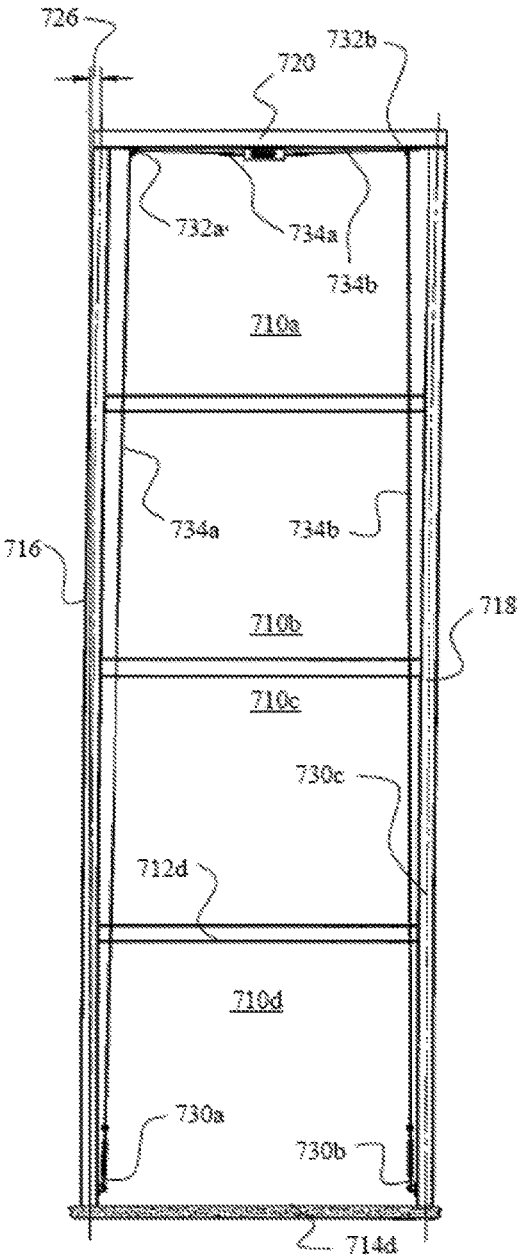

As shown in FIG. 7B, when under stress, from perhaps a potentially harmful event, relative motion can occur between the earth and the building structure, between the earth and at least a portion of the bays 710*a*-710*d*, and within or between each of the bays 710*a*-710*d*. This relative motion can cause deflection among the beams 712*a*-714*d* and columns 716-718 of the bays 710*a*-710*d*.

With the deflection, as shown within FIG. 7B, the upper beam 712*a* moves slightly towards a right hand direction relative to the lower beam 714*d*, as measured by a deflection angle 726. During this deflection, vertical columns 716-718 slightly tilt in a clockwise direction and an upper portion of each column 716-718 moves towards the right hand direction while attached to the upper beam 712*a*, and a lower portion of each column 716-718 remains attached to the lower beam 714*d*.

Figure 7C:
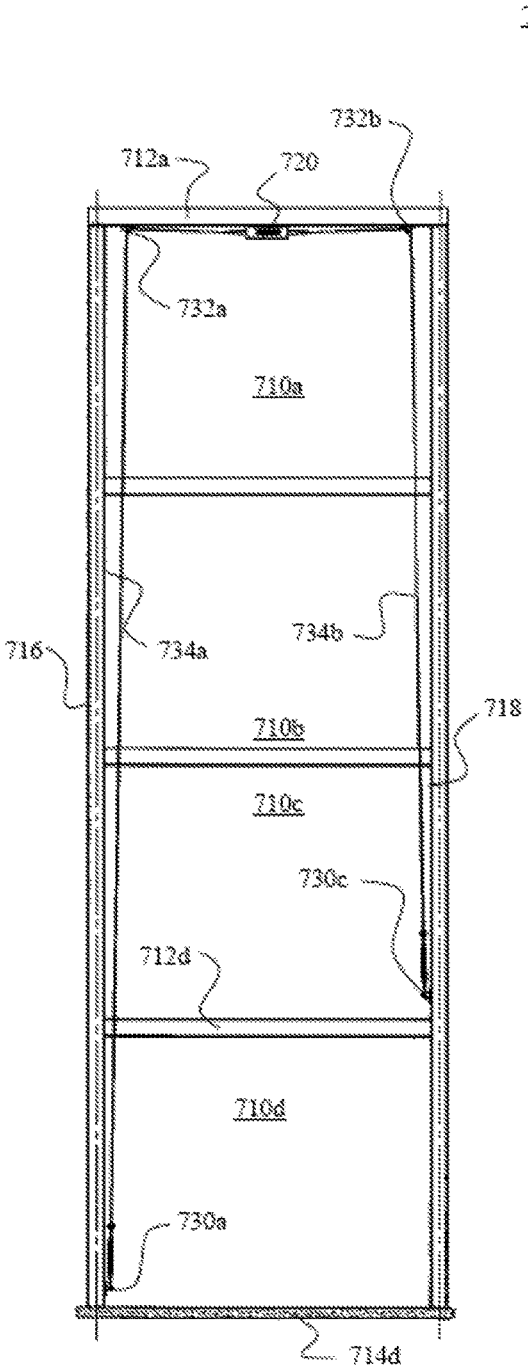

FIG. 7C shows a damping apparatus like that of FIG. 7A, except for that end anchors 730*a* and 730*c* are each located within different bays 710*d* and 710*c* respectively.

Figure 7D:
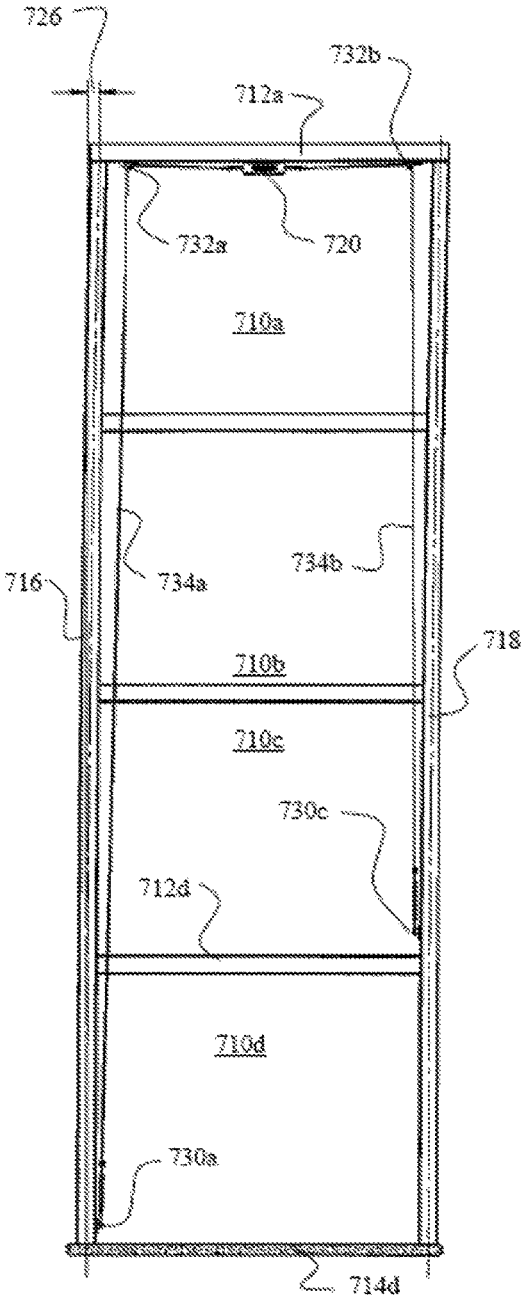

As shown in FIG. 7D, when under stress, relative motion can occur between the earth and the building structure, between the earth and the bays 710*a*-710*d*, and within and between the bays 710*a*-710*d*. This relative motion can cause deflection and/or deformation among the beams 712*a*-714*d* and columns 716-718 that are located along a perimeter of the bays 710*a*-710*d*.

With relative motion, as shown within FIG. 7D, the upper beam 712*a* moves slightly towards a right hand direction relative to the lower beam 714*d*, as measured by a deflection angle 726. During this deflection, vertical columns 716-718 slightly tilt in a clockwise direction where an upper portion of each column 716-718 moves towards the right hand direction while attached to the upper beam 712*a*, and at least a lower portion of each column 716-718 remains attached to the lower beam 714*d*.

As stated earlier, only a small amount of deflection of the one or more bays, as a result of relative motion, can cause catastrophic damage to one or more of the bays 710*a*-710*d* and to the building structure itself. For example, in typical building structures, as little as a (5) degree deflection angle to one or more bays, can cause damage to and/or even collapse of the building structure itself.

Figure 8A:
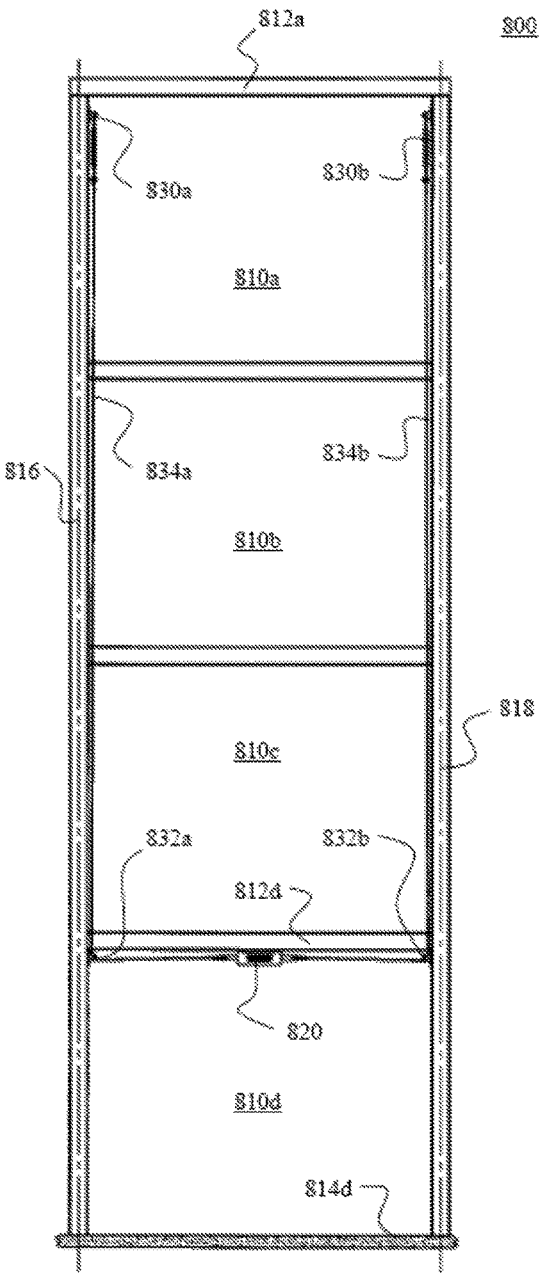
FIGS. 8A-8B illustrate an embodiment of a damping apparatus of the invention that also spans multiple stories within a building structure and that includes a damper located at a lower elevation than that other apparatus components.
Figure 8B:
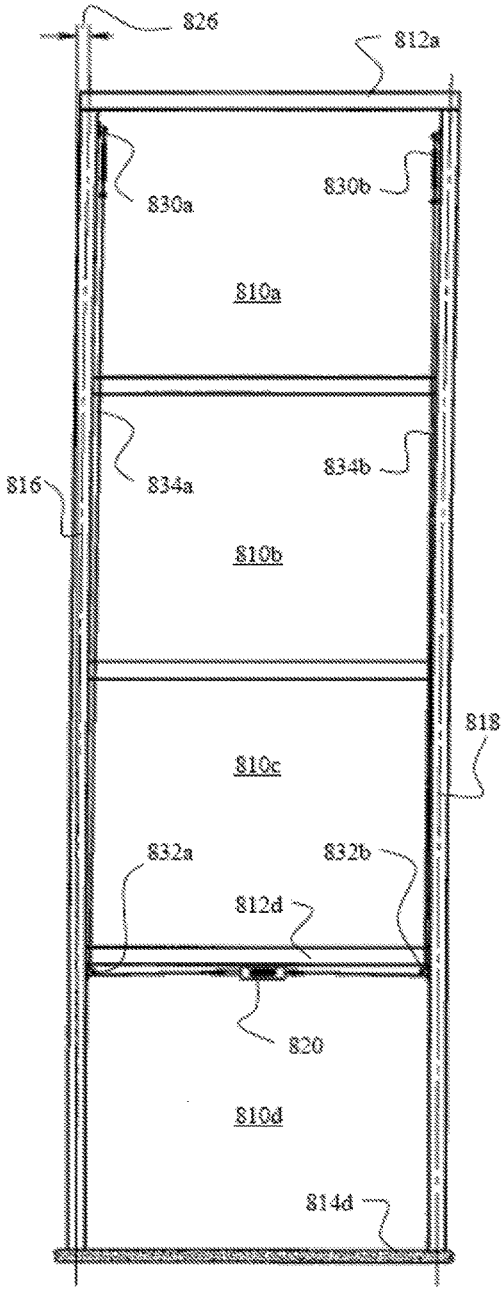

As stated earlier, in other embodiments, and as shown in FIGS. 8A-8B, the damper 720 can mounted on a structural member other than the upper beam 712*a*. For example, the damper 720 and intermediate anchors 732*a*-732*b* can be instead mounted on the lower beam 714*d* while the end anchors 730*a*-730*b*, 730*c*-730*d* are each located on an upper portion of the left and right columns respectively. Also, in some embodiments, the damper 720 is instead mounted on a column 316, 318 while the intermediate anchors 332*a*-332*b*, and optionally the end anchors 330*a*-330*b*, or end anchors 330*c*-330*d* are mounted onto a respective beam 312, 314.

In another one half sided (mirrored) embodiment, the damper 720 has one attachment interface, one cable 734*a*, one intermediate anchor 732*a* and one end anchor 730*a*, and consequently, resists motion traveling in only one first direction. This one half sided embodiment would resist relative motion along a first direction from a left hand to a right hand side of the bays 710*a*-710*d*.

However, another mirror image of this one half side embodiment, including another damper 720, one other cable 734*b*, one other intermediate anchor 732*b* and on other end anchor 730*b*, is designed to resist motion in a second direction of relative motion that is opposite to the first direction, and is installed into bay (not shown), that is adjacent to the bays 710*a*-710*d* for example, a set of bays that are located to the right hand side of the bays 710*a*-710*d* shown. In this arrangement, each side of the damping apparatus 700 is separately installed into each bay of the horizontally adjacent pairs of bays and is designed to resist relative motion from two opposite directions that collectively affects this set of bays. See FIGS. 6A-6B as an example of each mirrored one half side of a damping system 600 that is instead being installed into each half of one bay, instead of each being installed into a horizontally adjacent bay.

FIGS. 8A-8B illustrate an embodiment of a damping apparatus of the invention that has a damper of lower elevation than other apparatus components and that spans multiple bays within a building structure. Like other embodiments, this embodiment is designed to resist relative movement with respect to multiple bays within a building structure. This embodiment includes a damper 820 that is tethered via cables 834*a*-834*b* to end anchors 830*a*-830*b*, that are mounted to structural members that are located along a perimeter portion of multiple bays 810*a*-810*d*. As opposed to the embodiments 700, 750, the damper 820 of this embodiment is attached at a lower elevation than that of the end anchors 830*a*-830*b*, where elevation is measured as a distance relative to the surface of the earth.

The bays 810*a*-810*d* are located within a building structure. Like prior described damping apparatus embodiments, this damping apparatus embodiments 800 is also designed to resist against undesirable movement of the structural members that are located along the perimeter portion of these bays 810*a*-810*d*. This damping apparatus 800 is further designed to minimize visual and physical obstruction of the bays 810*a*-810*d* that is caused by installation of the damping apparatus itself, while it is disposed within the bays 810*a*-810*d*. Any obstruction caused by this damping apparatus is substantially less than obstruction caused by many other prior art damping apparatus, such as that shown in FIGS. 2A-2G.

As shown in FIG. 8A, a damper 820 is mounted (fixedly attached) to a structural member, specifically an upper beam 812*a*, that is located along a first side of the perimeter of the bay 810*a*. The damper 820 is designed to provide extension (tensile) resistance to pulling forces of cables 834*a*-834*b*, that are each attached to opposite sides of the damper 820. Cable 834*a* is attached to a first attachment interface (of the damper 820) that is located on a left hand side of the damper 820. The cable 834*b* is attached to a second attachment interface (of the damper 820) that is located on a right hand side of the damper 820.

Intermediate anchors 832*a* and 832*b* are each protrusions that are fixedly attached to and protrude away from a lower side of the upper beam 812*d*. The cables 834*a* and 834*b* are each arranged to make physical contact with and pass outside of and along a curved surface of each respective intermediate anchor 832*a*-832*b*, and to each fixedly attach to the damper 820. Each of the curved surfaces facilitates movement (sliding) of each respective cable 834*a*-834*b* while it is pressing against and passing outside of each respective intermediate anchor 732*a*-732*b*.

The cable 834*a* has a first end that is attached to the first attachment interface on the left hand side of the damper 820 and a second end that is attached to an end anchor 830*a*. The cable 834*b* has a first end that is attached to the second attachment interface located on the right hand side of the damper 820 and a second end that is attached to the second end anchor 830*b*. The end anchor 830*a* is fixedly attached to an inner side of the left column 816, which represents structural members located along a left hand side of the perimeter of the bays 810*a*-810*d*. The end anchor 830*b* is fixedly attached to an inner side of the right column 818, which represents structural members located along a right side of the perimeter of the bays 810*a*-810*d*. As shown, the bays 810*a*-810*d* form a rectangular shape having (4) right angle corners separating each horizontal beams 812*a*-812*d* and 814*d* and vertical columns 816-818.

As shown in FIG. 8B, when under stress, from perhaps a potentially harmful event, relative motion can occur between the earth and the building structure, between the earth and at least a portion of the bays 810*a*-810*d*, and within or between each of the bays 810*a*-810*d*. This relative motion can cause deflection among the beams 812*a*-814*d* and columns 816-818 of the bays 710*a*-710*d*.

With the deflection, as shown within FIG. 8B, the upper beam 812*a* moves slightly towards a right hand direction relative to the lower beam 814*d*, as measured by a deflection angle 826. During this deflection, vertical columns 816-818 slightly tilt in a clockwise direction and an upper portion of each column 816-818 moves towards the right hand direction while attached to the upper beam 812*a*, and a lower portion of each column 816-818 remains attached to the lower beam 814*d*.

As with the other embodiments described herein, other types of relative motion can occur along the perimeter of one or more bays. The apparatus described herein resists such relative motion that could deform one or more bays in a manner that would violate the functional or aesthetic design of any one of the bays protected by the apparatus described herein.

Options and variations, such as described in association with FIGS. 3A-3D, 4A-4B, 5A-5B and 6A-6B with respect to apparatus component characteristics, such as damper design and cable characteristics, can also be applied to the embodiments 7A-7D and 8A-8B. Also, embodiments including rods, such in association with FIGS. 4A-4B, 5A-5B and 6A-6B can also be applied to multiple bays as shown in FIGS. 7A-7D and FIGS. 8A-8B.

However, there are some advantages to a tensile force resisting cable based apparatus as compared to that of a compression force resisting rod based apparatus. For example, a diameter of a cable or a rod that is designed to resist 10,000 pounds of a tensile type of force, would be substantially smaller in size than a diameter of a rod that is designed to resist 10,000 pounds of a compression type of force. Hence, in some circumstances, a tensile resisting cable based apparatus can be designed to resist forces of a larger magnitude while being constructed from a smaller amount of force resisting material (steel for example), with respect to its weight and its displacement of volume, as compared to that of a compression force resisting rod based apparatus. As a result, a tensile force resisting apparatus can be designed to cause less overall obstruction within a building structure, especially when it is designed to span multiple bays, as compared to another compression force resisting apparatus that is designed to resist a same amount of force resulting from undesired motion within a building structure.

Figure 9A:
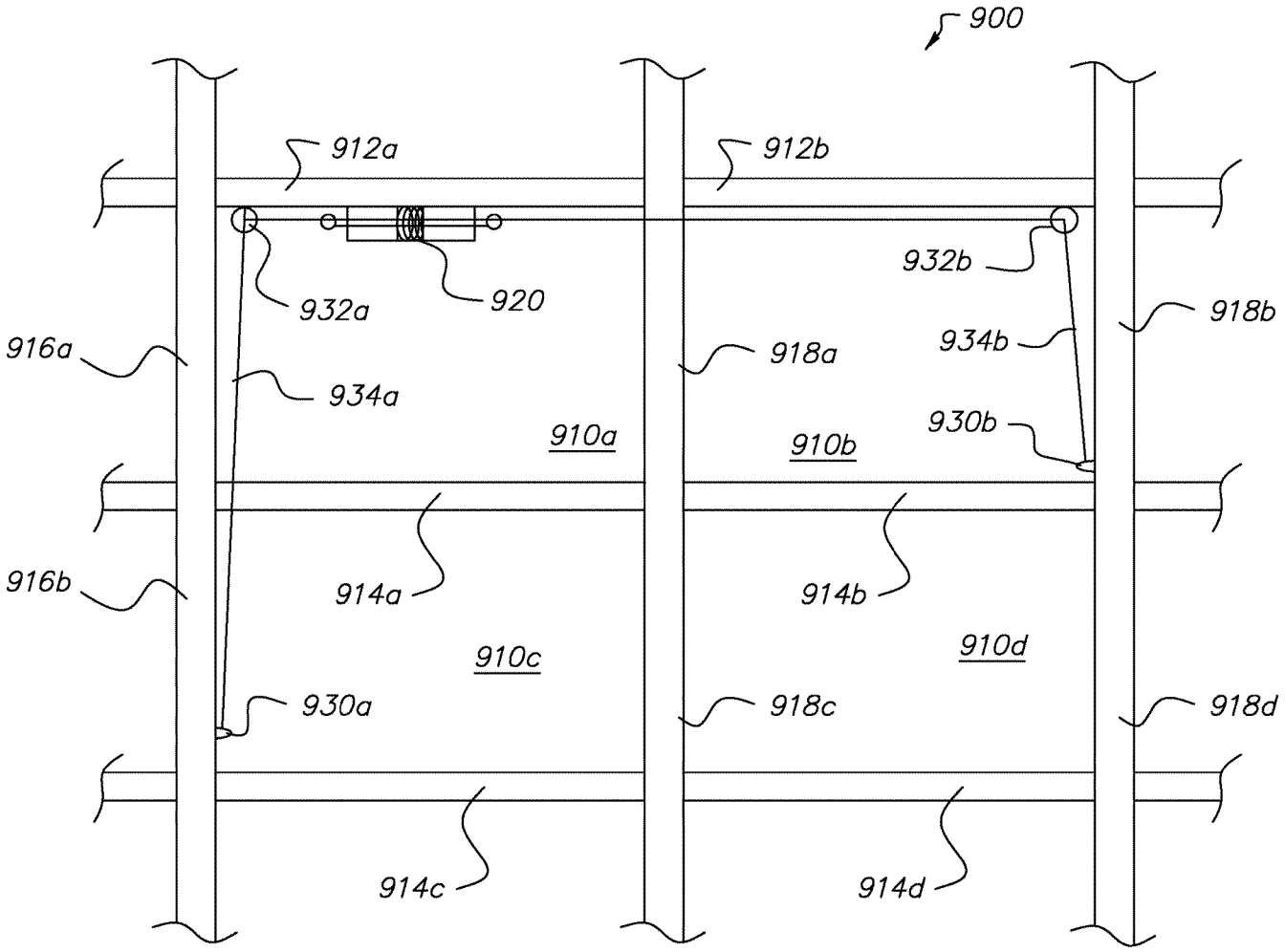
FIGS. 9A-9B collectively illustrate an embodiment of a damping apparatus of the invention that is designed to resist movement across a set of horizontally and vertically adjacent bays collectively spanning multiple stories within a building structure.
Figure 9B:
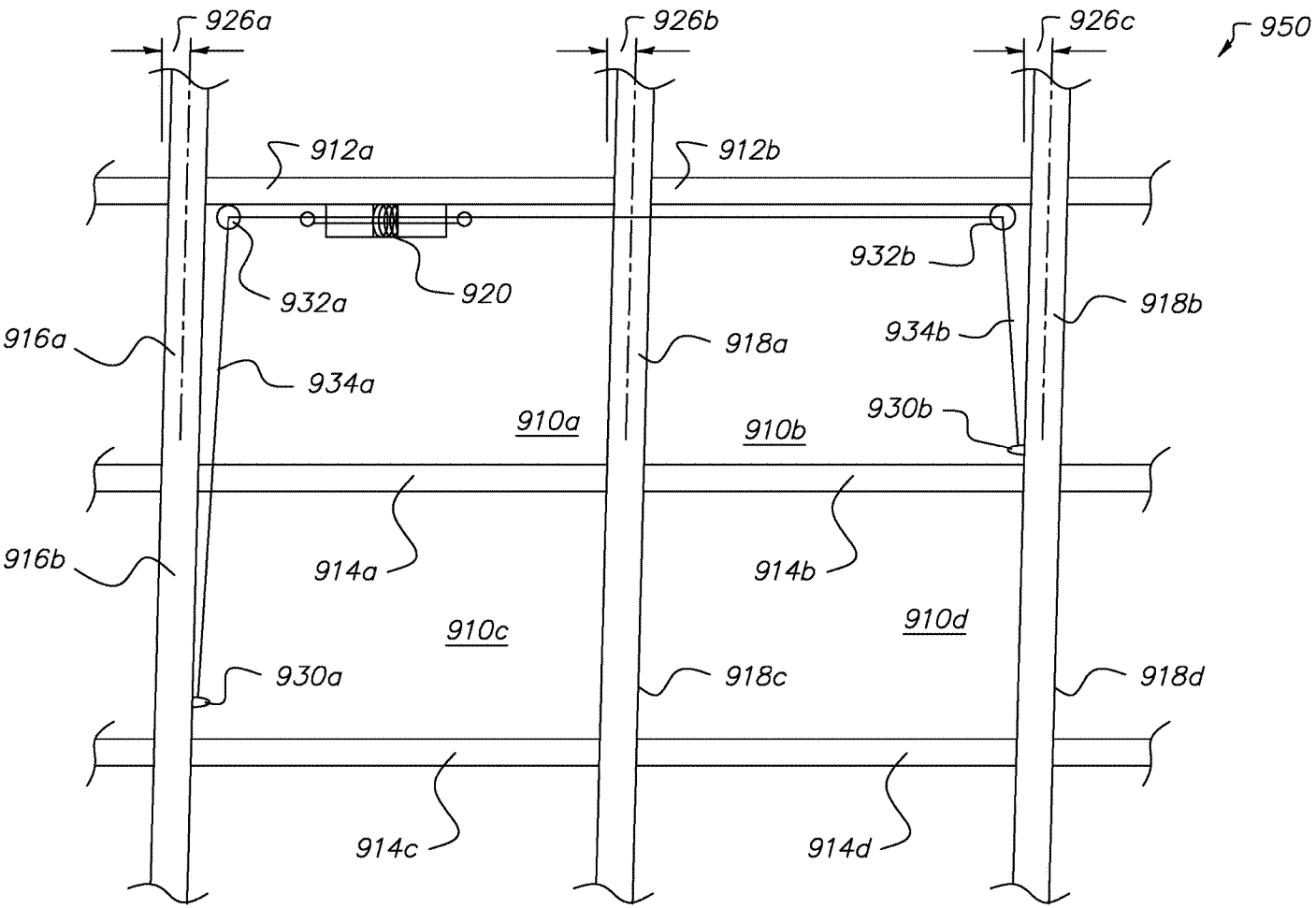

FIGS. 9A-9B collectively illustrate an embodiment 900 of a damping apparatus of the invention that is designed to resist movement across a set of horizontally and vertically adjacent bays collectively spanning multiple stories within a building structure. This type of embodiment is also referred to as a traverse bay installation. This embodiment 900 includes a damper 920 that is tethered via cables 934*a*-934*b* to end anchors 930*a*-930*b*, that are mounted to structural members that are located along a perimeter portion of multiple bays 910*a*-910*c*. The bays 910*a*-910*c* are located within a building structure and form an "L" shape. The bay 910*d* is also shown and is bounded by columns 918*c*-918*d*. In this building structure, column 918*a* and column 918*c* are one same column and column 918*b* and 918*d* are also one same column. As a result, although the apparatus is collectively attached in (3) bays 910*a*-910*c*, the apparatus at least partially protects bay 910*d* from movement of its columns 918*c*-918*d*. As shown here, this set of (4) bays forms a 2×2 matrix of bays that are located to form one contiguous rectangle within one side of the building structure.

In other embodiments, the set of bays can form other various arrangements, including arrangements that span across a corner of a building. In such an arrangement, an intermediate anchor, such as a loop shaped intermediate anchor, re-directs the direction of cable by 90 degrees, between a damper and an end anchor. Preferably, a loop shaped intermediate anchor receives a cable into an aperture to surround the cable and prevent it from moving off and/or away from the intermediate anchor itself. In this type of embodiment, laterally and optionally vertically adjacent bays span across two different sides of a building structure.

Like prior described damping apparatus embodiments, this damping apparatus embodiment 900 is also designed to resist against undesirable movement of the structural members that are located along the perimeter portion of these bays 910*a*-910*d*. This damping apparatus 900 is further designed to minimize visual and physical obstruction of the bays 910*a*-910*d* that is caused by installation of the damping apparatus itself, while it is disposed within the bays 910*a*-910*d*. Any obstruction caused by this damping apparatus is substantially less than obstruction caused by many other prior art damping apparatus, such as that shown in FIGS. 2A-2G.

As shown in FIG. 9A, a damper 920 is mounted (fixedly attached) to a structural member, specifically an upper beam 912*a*, that is located along a first side of the perimeter of the bay 910*a*. The damper 920 is designed to provide extension (tensile) resistance to pulling forces of cables 934*a*-934*b*, that are each attached to opposite sides of the damper 920. Cable 934*a* is attached to a first attachment interface (of the damper 920) that is located on a left hand side of the damper 920. The cable 934*b* is attached to a second attachment interface (of the damper 920) that is located on a right hand side of the damper 920.

Intermediate anchors 932*a* and 932*b* are each protrusions that are fixedly attached to and protrude away from an inner side of the upper beam 912*a* and upper beam 912*b* respectively. The cables 934*a* and 934*b* are each arranged to make physical contact with and pass outside of and along a curved surface of each respective intermediate anchor 932*a*-932*b*, and to each fixedly attach to the damper 920. Each of the curved surfaces facilitates movement (sliding) of each respective cable 934*a*-934*b* while it is pressing against and passing inside of a loop shaped intermediate anchor, or passing outside of each respective non-loop intermediate anchor 932*a*-932*b*.

The cable 934*a* has a first end that is attached to the first attachment interface on the left hand side of the damper 920 and a second end that is attached to an end anchor 930*a*. The cable 934*b* has a first end that is attached to the second attachment interface located on the right hand side of the damper 920 and a second end that is attached to the second end anchor 930*b*. The end anchor 930*a* is fixedly attached to an inner side of the left column 916, which represents structural members located along a left side of the perimeter of the bays 910*a*, 910*c*. The end anchor 930*b* is fixedly attached to an inner side of the right column 918*b*, which represents structural members located along a right side of the perimeter of the bays 910*b*, 910*d*. As shown, the bays 910*a*-910*d* form a rectangular shape having (4) right angle corners spanning between each horizontal beams 912*a*-912*b*, 914*c*-914*d* and vertical columns 916*a*-916*b*, 918*b*-918*d*.

As shown in FIG. 9B, when under stress, from perhaps a potentially harmful event, relative motion can occur between the earth and the building structure, between the earth and at least a portion of the bays 910*a*-910*d*, and within or between each of the bays 910*a*-910*d*. This relative motion can cause deflection among the beams 912*a*-912*b*, 914*a*-914*b*, 914*c*-914*d* and columns 916*a*-916*b*, 918*a*,918*c* and 918*b*, 918*d* of the bays 910*a*-910*d*.

With the deflection, as shown within FIG. 9B, the upper beams 912*a*-912*b* move slightly towards a right hand direction relative to the lower beams 914*c*-914*d*, as measured by a deflection angles 926*a*-926*c*. During this deflection, at least one of the vertical columns 916*a*-916*b*, 918*a*-918*c*, 918*b*-918*d* slightly tilt in a clockwise direction and an upper portion of each column 916*a*-916*b*, 918*a*-918*c* and 918*b*-918*d* move towards the right hand direction while attached to the upper beams 912*a*-912*b*, and a lower portion of each column 916*b*, 918*c*-918*d* remains attached to the lower beams 914*c*-914*d*.

In summary, in one aspect, the invention provides an apparatus for resisting potentially destructive movement within a building structure. The apparatus includes a first damper designed for resisting at least one extension force and having one or more attachment interfaces and that is fixedly mounted to a structural member located along a first side of a first bay within a building structure, and the apparatus includes a first cable having a first end that is attached to a first attachment interface of the first damper, and having an intermediate portion that passes through a receiving portion of a first intermediate anchor and having a second end that is attached to a first end anchor; and where the first end anchor is fixedly mounted on a structural member located along a second side of the first bay, and where relative motion between the first side and the second side of the first bay causes an extension force to be applied to the first damper causing resistance to the relative motion.

In some embodiments, the first intermediate anchor is fixedly mounted to a structural member located along the first side of the first bay or along the second side of the first bay. Also, the first end anchor can be mounted outside of a centerline of rotation of the structural member located along a second side of the first bay. Optionally, the first damper has a second attachment interface and where a second cable has a first end that is attached to the second attachment interface of the first damper, and the cable having an intermediate portion that passes through a receiving portion of a second intermediate anchor and having a second end that is attached to a second end anchor. In some embodiments, the second intermediate anchor is fixedly mounted to a structural member located along a third side of the first bay.

In some embodiments, a second damper that is fixedly mounted in a second bay, the second bay being adjacent to the first bay and where the second damper is designed to resist a force that is directed in an opposite direction to that of the at least one extension force for which the first damper is designed to resist.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An apparatus for resisting potentially destructive movement within a building structure, comprising:

a damper designed for resisting at least one extension force and having one or more attachment interfaces and that is fixedly mounted to a structural member located along a first side of a bay within a building structure;

a first cable having a first end that is attached to a first attachment interface of said damper, and having an intermediate portion that passes through a receiving portion of a first intermediate anchor and having a second end that is attached to a first end anchor; and wherein said first end anchor is fixedly mounted on a structural member located along a second side of said bay; and wherein relative motion between said first side and said second side of said bay causes an extension force to be applied to said damper causing resistance to said relative motion.

2. The apparatus of claim 1 wherein said first intermediate anchor is fixedly mounted to a structural member located along said first side of said bay.

3. The apparatus of claim 1 wherein said first intermediate anchor is fixedly mounted to a structural member located along said second side of said bay.

4. The apparatus of claim 1 wherein said first end anchor is mounted outside of a centerline of rotation of said structural member located along a second side of said bay.

5. The apparatus of claim 1 wherein said damper has a second attachment interface and wherein a second cable has a first end that is attached to said second attachment interface of said damper, and said cable having an intermediate portion that passes through a receiving portion of a second intermediate anchor and having a second end that is attached to a second end anchor.

6. The apparatus of claim 5 wherein said second intermediate anchor is fixedly mounted to a structural member located along a third side of said bay.

7. The apparatus of claim 1 wherein there is no point location within said damper, said first cable, said first intermediate anchor or said first end anchor, that is located as or more proximate to a geometric center point location within said bay, in relation to any one nearest side of said bay; without effect of said relative motion.

8. An apparatus for resisting potentially destructive movement within a building structure, comprising:

a first damper designed for resisting at least one extension force and having one or more attachment interfaces and that is fixedly mounted to a structural member located along a first side of a first bay within a building structure;

a first cable having a first end that is attached to a first attachment interface of said first damper, and having an intermediate portion that passes through a receiving portion of a first intermediate anchor and having a second end that is attached to a first end anchor; and wherein said first end anchor is fixedly mounted on a structural member located along a second side of a second bay; and wherein relative motion between said first side of said first bay and said second side of said second bay causes an extension force to be applied to said first damper causing resistance to said relative motion.

9. The apparatus of claim 8 wherein said first damper has a second attachment interface and wherein a second cable has a first end that is attached to said second attachment interface of said first damper, and said cable having an intermediate portion that passes through a receiving portion of a second intermediate anchor and having a second end that is attached to a second end anchor.

10. The apparatus of claim 9 wherein said second end anchor is fixedly mounted to a structural member located along a perimeter of a third bay.

11. The apparatus of claim 8 wherein at least one of said first end anchor and said first intermediate anchor is located away from said first bay.

12. The apparatus of claim 9 wherein at least one of said second end anchor and said second intermediate anchor is located away from said first bay.

13. The apparatus of claim 8 including a second damper that is fixedly mounted in a in a second bay, said second bay being adjacent to said first bay and where said second damper is designed to resist a force that is directed in an opposite direction to that of said at least one extension force for which said first damper is designed to resist.

14. The apparatus of claim 13 wherein said second damper has a has an attached cable, and an associated intermediate anchor and end anchor, at least some of which is located away of said second bay.

15. The apparatus of claim 8 wherein there is no point location within said first damper, said first cable, said first intermediate anchor or said first end anchor, that is located as or more proximate to a geometric center point location within said first bay, in relation to any one nearest side of said first bay; without effect of said relative motion.

16. The apparatus of claim 8 wherein there is no point location within said first damper, said first cable, said first intermediate anchor or said first end anchor, that is located as or more proximate to a geometric center point location within said second bay, in relation to any one nearest side of said second bay; without effect of said relative motion.

17. A method for resisting potentially destructive movement within a building structure, comprising the steps of:

providing a damper designed for resisting at least one extension force and having one or more attachment interfaces and that is fixedly mounted to a structural member located along a first side of a bay within a building structure;

providing a first cable having a first end that is attached to a first attachment interface of said damper, and having an intermediate portion that passes through a receiving portion of a first intermediate anchor and having a second end that is attached to a first end anchor; and wherein said first end anchor is fixedly mounted on a structural member located along a second side of said bay; and wherein relative motion between said first side and said second side of said bay causes an extension force to be applied to said damper causing resistance to said relative motion.

18. The method of claim 17 wherein there is no point location within said damper, said first cable, said first intermediate anchor or said first end anchor, that is located as or more proximate to a geometric center point location within said bay, in relation to any one nearest side of said bay; without effect of said relative motion.

19. The method of claim 17 wherein said first end anchor is fixedly mounted on a structural member located along a second side of a second bay, and wherein relative motion between said first side of said first bay and said second side of said second bay causes an extension force to be applied to said first damper causing resistance to said relative motion.

20. The method of claim 19 wherein there is no point location within said damper, said first cable, said first intermediate anchor or said first end anchor, that is located as or more proximate to a geometric center point location within said second bay, in relation to any one nearest side of said second bay; without effect of said relative motion.

* * * * *